US006997390B2

(12) United States Patent
Alles

(10) Patent No.: US 6,997,390 B2
(45) Date of Patent: Feb. 14, 2006

(54) RETROFIT HVAC ZONE CLIMATE CONTROL SYSTEM

(75) Inventor: Harold Gene Alles, Lake Oswego, OR (US)

(73) Assignee: Home Comfort Zones, Inc., Beaverton, OR (US)

( * ) Notice: Subject to any disclaimer, the term of this patent is extended or adjusted under 35 U.S.C. 154(b) by 0 days.

(21) Appl. No.: 11/028,845

(22) Filed: Jan. 3, 2005

(65) Prior Publication Data

US 2005/0116055 A1 Jun. 2, 2005

Related U.S. Application Data

(62) Division of application No. 10/249,198, filed on Mar. 21, 2003.

(51) Int. Cl.
*F24F 7/00* (2006.01)

(52) U.S. Cl. ..... 236/49.4; 62/186

(58) Field of Classification Search ..... 236/1 B, 236/49.1, 49.3, 49.4, 51; 32/186; 62/186

See application file for complete search history.

(56) References Cited

U.S. PATENT DOCUMENTS

| | | | | |
|---|---|---|---|---|
| 3,703,140 | A * | 11/1972 | Gutheim | 454/303 |
| 4,178,840 | A * | 12/1979 | Caknis | 454/267 |
| 4,324,358 | A * | 4/1982 | Tulowiecki et al. | 236/49.4 |
| 4,537,245 | A * | 8/1985 | Nishimura et al. | 165/203 |
| 4,874,127 | A * | 10/1989 | Collier | 236/49.5 |
| 5,167,366 | A * | 12/1992 | Desmarais et al. | 236/49.3 |
| 5,169,121 | A * | 12/1992 | Blanco et al. | 251/129.12 |
| 5,180,102 | A * | 1/1993 | Gilbert et al. | 236/49.3 |
| 5,348,270 | A * | 9/1994 | Dinh | 251/61.1 |
| 5,704,545 | A * | 1/1998 | Sweitzer, Jr. | 237/8 R |
| 5,769,315 | A * | 6/1998 | Drees | 236/49.3 |
| 6,482,080 | B1 * | 11/2002 | Wilson et al. | 454/119 |
| 6,725,914 | B1 * | 4/2004 | Petterson | 165/208 |

FOREIGN PATENT DOCUMENTS

| | | | |
|---|---|---|---|
| JP | 4-214134 A | * | 8/1992 |
| JP | 10-25825 A | * | 1/1998 |

* cited by examiner

*Primary Examiner*—Mohammad M. Ali

(57) ABSTRACT

A low cost and easy to install zone climate control system for retrofit to an existing forced air HVAC system, that provides independent minute-by-minute, day-by-day, and room-by-room climate control, including easy to use methods for specifying temperature schedules and providing local temperature control, and providing detailed energy use information so occupants can make informed cost versus comfort decisions.

4 Claims, 22 Drawing Sheets

FIG. 4
FIG. 4A
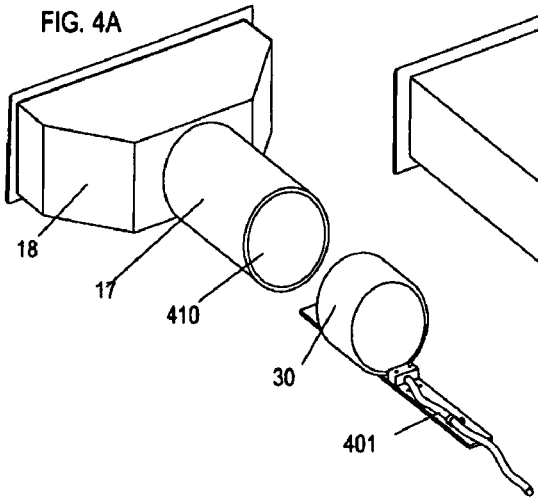
FIG. 4B
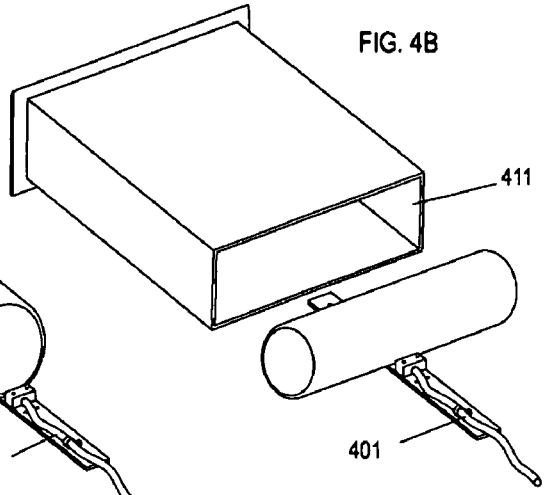
FIG. 4C
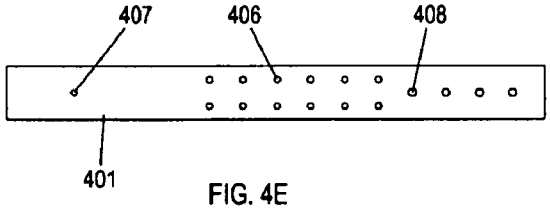
FIG. 4D
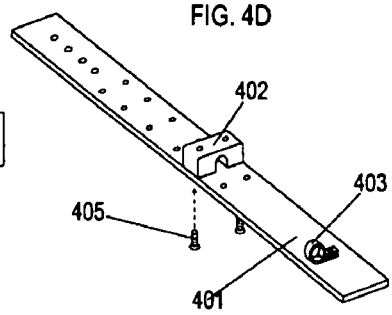
FIG. 4E
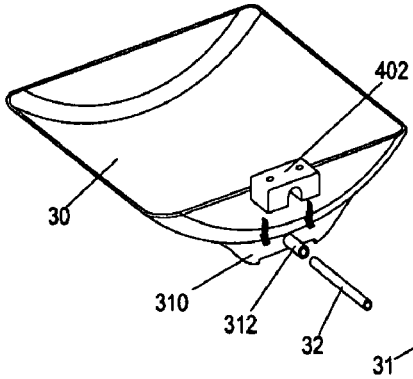
FIG. 4F
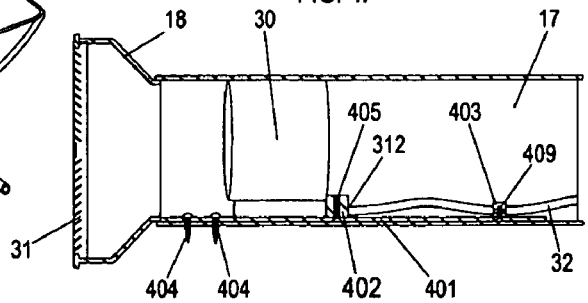

PLENUM WALL
PRESSURE
VACUUM
PLENUM WALL
PRESSURE
VACUUM
40
32
32
501
502
503
504
505
506
507
510
511
512
513
514
515
516
520
521

505
601
503
606
603
605
604
514
516
510
513
602

700
710
702
730
744
742
741
743
811
514
800
510
810
514
703
705
601
602
744
743
742
741
730
802
521
730
742
744
741
743
801
520

FIG. 11
FIG. 11B
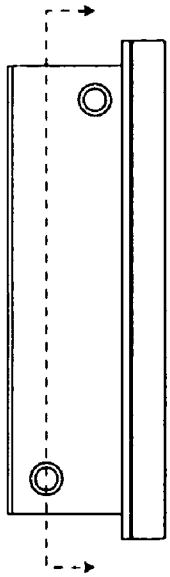
FIG. 11D
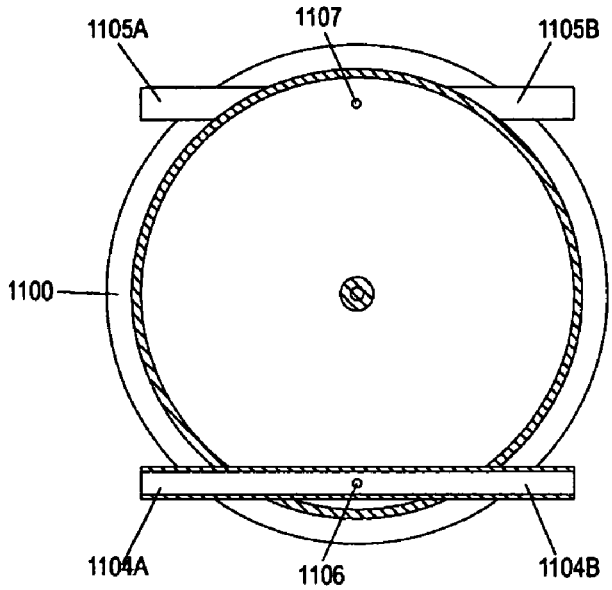
FIG. 11C
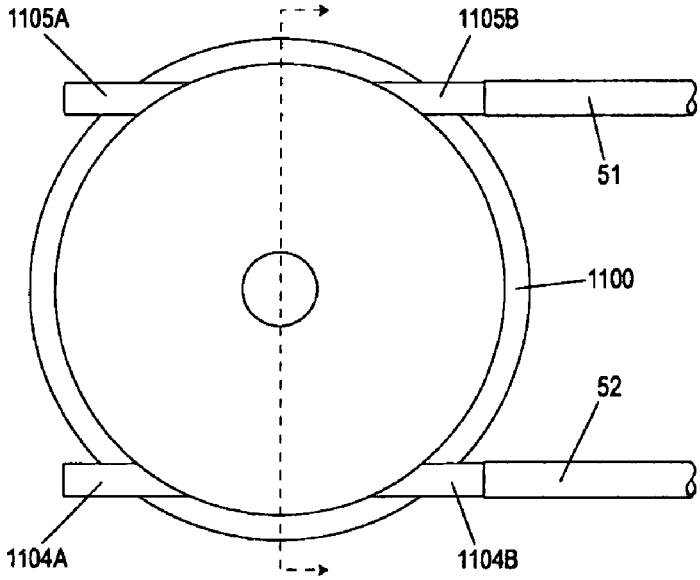
FIG. 11A
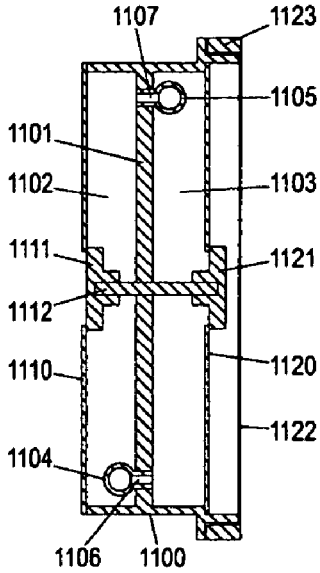

FIG. 12
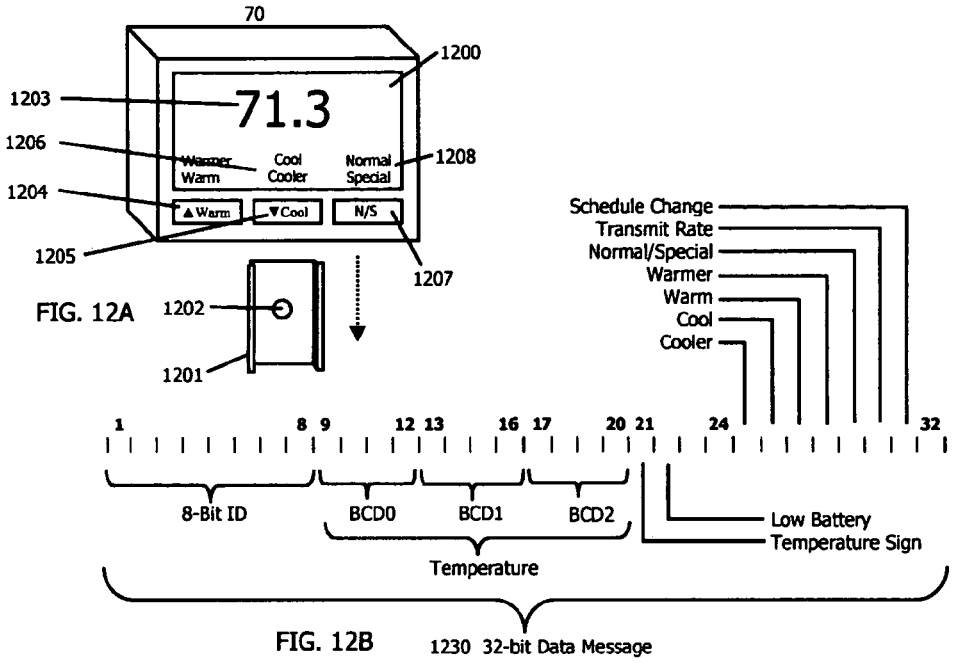
FIG. 12A
FIG. 12B
FIG. 13
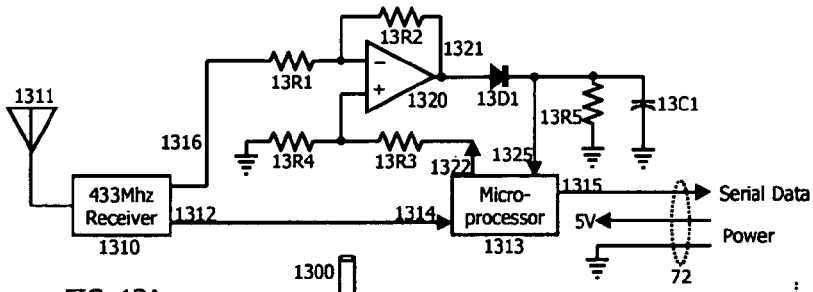
FIG. 13A
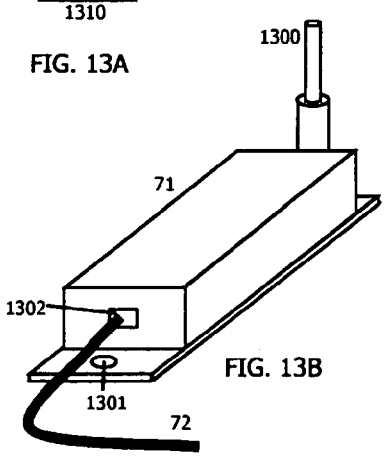
FIG. 13B
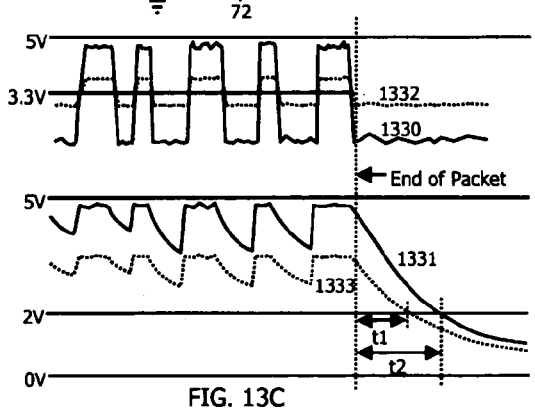
FIG. 13C 1905
31
1900
82
1904
1821
1801
1814
OUTSIDE AIR DUCT
1902
1901
1905
1903
1820
1900
INSIDE AIR DUCT
1906
82

FIG. 24

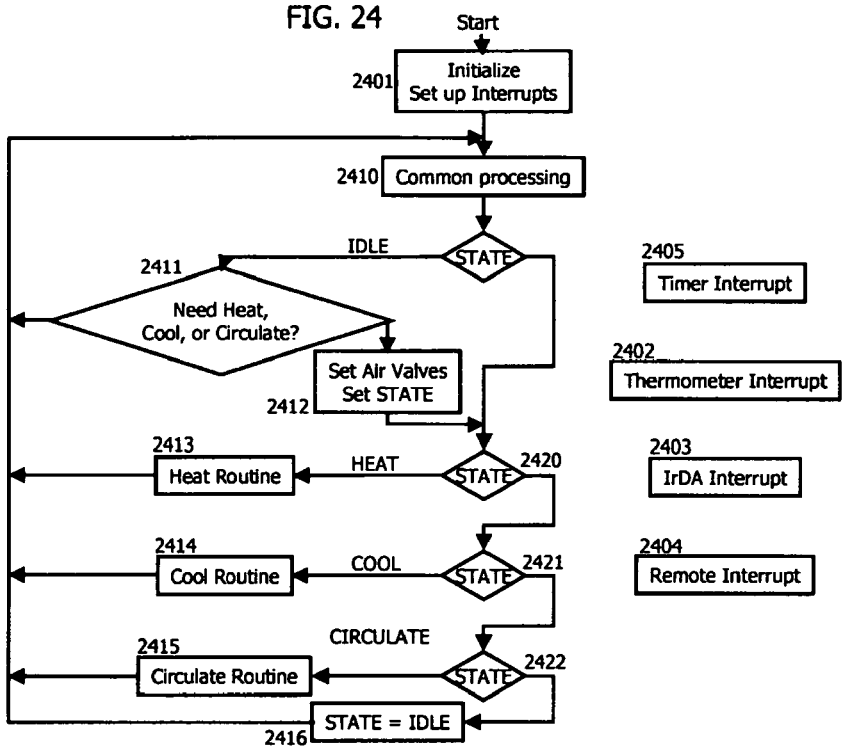

FIG. 25

```
static volatile struct zones{
    unsigned char ID;              // identity number of thermometer
    char *ZoneName;                // pointer to ASCII name of room
    unsigned char ZoneValves[5];   // air valves that control air flow to room
    unsigned char Trunk;           // trunk that feeds the vents for this room
    unsigned char Floor;           // the room in on this floor, 1 is bottom floor
    int AirFlow;                   // relative airflow to this room, includes all air ducts
    int AirVol;                    // air volume of room: cubic feet / 80
    int TargetTime;                // predicted heating time or cooling time needed
    int HtoTemp;                   // Heat when below temperature
    int CtoTemp;                   // Cool when above temperature
    int ZTS;                       // index of temperature schedule for room
    int TSPSpecial                 // Special TS Program
    int ZoneTemp;                  // current temperature in room
    int MinTemp;                   // minimum temperature during 24 hour period (reset at midnight)
    int MaxTemp;                   // maximum temperature during 24 hour period (reset at midnight)
    char ZoneT_D[10];              // time of the most recent temperature report in ASCII
    int LastTime;                  // time (in seconds since midnight) of the last temperature report
    int LongestTime;               // longest time between temperature reports during 24 hour period
    unsigned char Switch;          // contains the last switch value reported by the thermometer
    unsigned char SwitchReported;  // contains the current switch value reported by the thermometer
    unsigned char Battery;         // contains the low battery warning
    unsigned char Flag;            // set by radio receiver interrupt, cleared in main loop
    int T[5];                      // temporary storage for various calculations.
}zone[20];
```

15
1720
2820
2803
2820
2801
31
2800
18
2810
2815
2814
2804
2813
2811
2812
2821
2822
2802
32

RETROFIT HVAC ZONE CLIMATE CONTROL SYSTEM

RELATED APPLICATION

This application is a divisional of co-pending application Ser. No. 10/249,198 filed Mar. 21, 2003 entitled "An Improved Forced-Air Zone Climate Control System for Existing Residential House" by this inventor, and claims benefit of its priority date.

BACKGROUND OF INVENTION

This invention relates to controlling residential forced air HVAC systems, specifically an improved zone climate control system, for installation in an existing HVAC system, that is less expensive, easier to install, and provides more utility than the prior art, such that a plurality of rooms in the residence each have independent temperature regulation according to predetermined temperature schedules and locally entered temperature commands, and such that the air in each room is heated or cooled according to the occupancy and the activity in said room, improving the comfort of the occupants and reducing the energy used to heat or cool the residence.

The majority of single-family houses in the United States have forced air central heating systems. Many of these also have air conditioners that use the same air distribution system. These heating, ventilation, and air conditioning (HVAC) systems are typically controlled by a single, centrally located thermostat. The thermostat controls the HVAC equipment to maintain a constant temperature at the thermometer. The temperatures in other rooms of the house are not actively controlled, so the temperatures in different rooms can differ by many degrees from the temperature at the thermostat.

Manually adjusting the airflow to each room is the primary method available to control the temperature away from the thermostat. However, the temperatures away from the thermostat depend on many dynamic factors such as the season (heating or cooling), the outside temperature, radiation heating and cooling through windows, and the activities of people and equipment in the rooms. The desired temperature also depends on the activity of the occupant, for example lower temperatures for sleeping and higher temperatures for relaxing. Maintaining comfortable temperatures requires constant adjustment, or may not be possible.

These temperature control problems are well known to HVAC suppliers, installers, and house occupants. Zone control systems have been developed to improve temperature control. Typically, a small number of thermostats are located in different areas of the house, and a small number of mechanized airflow dampers are placed in the air distribution ducts. A control unit dynamically controls the HVAC equipment and the airflow to simultaneously control the temperatures at each thermostat. These conventional systems are difficult to retrofit, and provide limited function and benefit. They are provided by several companies such as: Honeywell, 101 Columbia Road, Morristown, N.J. 07962; Carrier, One Carrier Place, Farmington, Conn. 06034; Jackson Systems, LLC100 E. Thompson Rd., Indianapolis, Ind. 46227; Arzel Zoning Technology, Inc., 4801 Commerce Parkway, Cleveland, Ohio 44128; Duro Dyne, 81 Spence Street, Bay Shore, N.Y. 11706; and EWC Controls, Inc., 385 Highway 33, Englishtown, N.J. 07726.

With only a few zones, there can still be significant temperature variations from room to room within a zone. A few systems have proposed thermostats for each room and airflow control devices for each air vent, but no practical solution for easy retrofit has been disclosed. As the number of independent zones increases, it becomes more complex to specify an appropriate setting for each zone while providing convenient centralized and remote control. Typical residential HVAC systems are designed to produce one fixed rate of heating and cooling, so adapting the existing systems to provide heating or cooling for only one or two rooms is difficult. These systems do provide methods to measure energy usage or provide information to help reduce energy use. They have not been widely adopted, because they are expensive, difficult and intrusive to install in most existing houses, and provide limited utility and benefit compared to their cost and inconvenience.

U.S. Pat. No. 5,348,078 issued Sep. 30, 1994 and U.S. Pat. No. 5,449,319 issued Sep. 12, 1995 to Dushane et. al describe a retrofit room-by-room zone control system for residential forced air HVAC systems that uses complex electrically activated airflow control devices at each air vent. The devices are mechanically complex, each with a radio receiver, servo motor, and multiple mechanical louvers. The devices are powered by batteries that are recharged by a generator powered by airflow through the air vent. Another embodiment is described that uses wires connected to a central control unit to control the airflow control devices, adding complexity to the installation process. The airflow control devices replace the existing air grills, so the installation is visible, and multiple sizes and shapes of airflow control devices are needed to accommodate the variety of air vents found in houses. The devices are expensive and have no shared mechanisms for control or activation to reduce the cost of the multiple devices required. The preferred embodiment uses household power wiring for communications between the thermostats and the central control, requiring visible wires from a power outlet to the thermostat. A cited advantage of the system is it does not have sensors inside the ducts, so the system cannot make control decisions based on plenum pressure or plenum temperature, therefore excessive noise and temperatures may occur for some settings of the airflow control devices. The thermostats and common controller have complex interfaces with limited functionality, making the system difficult to use.

U.S. Pat. No. 5,704,545 issued Jan. 6, 1998 to Sweitzer describes another zone system where the airflow control devices are louvers actuated by a local electromechanical mechanism. This invention requires modification to the air ducts and connecting wires from the airflow control devices to the common controlling device. This system is expensive and difficult to retrofit.

U.S. Pat. No. 4,545,524 issued Oct. 8, 1985, U.S. Pat. No. 4,600,144 issued Jul. 15, 1986, U.S. Pat. No. 4,742,956 issued May 10, 1988, and U.S. Pat. No. 5,170,986 issued Dec. 15, 1992 to Zelczer, et al. describe a variety of inflatable bladders used as airflow control devices in air ducts. All of these are adapted for mounting in a way that requires access to the air ducts for cutting holes and inserting devices into the duct, and for the controlling air tube to pass from the inside of the air duct to the outside of the duct for passage to the device that provides the air for the bladders. These airflow control devices do not provide a way for non-intrusive installation.

U.S. Pat. No. 4,522,116 issued Jun. 11, 1985, U.S. Pat. No. 4,662,269 issued May 5, 1987, U.S. Pat. No. 4,783,045 issued Nov. 8, 1988, and U.S. Pat. No. 5,016,856 issued May 21, 1991 to Tartaglino describe a series of inflatable bladders of different shapes and control methods. The disclosed control methods relate to the air pressure and vacuum used to inflated and deflate the bladders. The bladder shapes are novel but different from those used in the present invention.

U.S. Pat. No. 5,234,374 issued Aug. 10, 1993 to Hyzyk, et al. describes an inflatable bladder used as an airflow control device installed inside an air duct at an air vent. The bladder is inflated by a small blower also mounted in the air vent and powered by a battery. It receives control signals from a separate thermostat located in the room. This devices uses substantial power and battery life is limited. Since the blower for inflating the bladder is located at the air vent, noise from the blower is a problem which the inventor provides a muffler to help control. Each bladder is an independent unit and there is no sharing of components for controlling or powering, so there are no savings when many airflow devices are used in a zone control system. The device does provide a practical solution for providing centrally controllable airflow devices for each air vent in a house.

U.S. Pat. No. 5,772,501 issued Jun. 30, 1998 to Merry, et al. describes a system for selectively circulating unconditioned air for a predetermined time to provide fresh air. The system uses conventional airflow control devices installed in the air ducts and the system does not use temperature difference to control circulation. This system is difficult to retrofit and does not exploit selective circulation to equalize temperatures.

U.S. Pat. No. 5,024,265 issued Jun. 18, 1991 to Buchholz, et al. describes a zone control system with conventional thermostats located in each zone. This system teaches one method for distributing conditioned air to zones based dependent on the zone that has the greatest need for conditioning. However, the thermostats make on-off requests for conditioning based on local set points, so the system must deduce need based on the duty cycle of on-off requests. The control system does not have access to the actual temperature in the zone nor any other characteristic of the zone such as thermal resistance or thermal capacity. This system is not practically adaptable to a residential system.

U.S. Pat. No. 5,341,988 issued Aug. 30, 1994 to Rein, et al. describes a hierarchical wireless control system for zone control. This system is designed for large commercial buildings and is not practically adaptable for retrofit to a house.

U.S. Pat. No. 6,116,512 issued Sep. 12, 2000 to Dushane, et al. describes a wireless thermostat system where each wireless device has a number of programming functions for setting temperature and time schedules. Each thermostat function must be programmed at each device and there is no method to share programming effort or information between devices. The cost and complexity of a full functioning thermostat is duplicated for each device. The number of input buttons and the display capabilities at each device is limited, so programming is complex and functionality is limited.

U.S. Pat. No. 6,213,404 issued Apr. 10, 2001 to Dushane, et al. describes another wireless thermostat device comprising battery wireless thermometers reporting to a wireless thermostat. This device provides no method for entering commands at the wireless thermometer and uses a fixed slow rate of reporting the temperature stored at the wireless thermometer. The system is not adapted for use with a zone control system.

U.S. Pat. No. 5,224,648 issued Jul. 6, 1993 to Simon, et al. describes a wireless HVAC system using spread spectrum radio transmission technology. The control architecture requires reliable two-way communication and is not practical for battery powered operation. The described system cannot operate with infrequent and unreliable transmissions from the wireless thermometers and is not adaptable for low cost installation into existing residential HVAC systems.

U.S. Pat. No. 5,711,480 issued Jan. 27, 1998 to Zepke, et al. describes and claims using wireless SAW transmitters and receivers in an HVAC system. The patent teaches only the replacement of other wireless technology such as described in previously cited U.S. Pat. No. 5,224,648 with SAW based wireless technology and does not add to the art of retrofit zone climate control.

U.S. Pat. No. 5,782,296 issued Jul. 21, 1998 to Mehta describes a thermostat that has several 24-hour temperature schedules that are specified by entering a complex sequence of commands using a small number of buttons. The display can only display a small portion of the data of each temperature schedule at one time. Using this type of interface to program multiple temperature schedules for multiple zones would take great effort and is complex. This device is not practically adaptable for use in a room-by-room zone control system for a house.

U.S. Pat. No. 4,819,714 issued Apr. 11, 1989 to Otsuka, et al. describes a device for specifying multiple temperature schedules for multiple thermostats. It uses a display and a set of buttons designed specifically for this purpose. The system is designed for use with programmable thermostats that can be set locally or the device can program the thermostats with data entered at the central control. This device provides only a way of programming each thermostat with a common device, and is not adapted to controlling rooms within a house, a group of rooms, or the entire house, with a single temperature schedule. It provides no means for saving temperature schedules or grouping temperature schedules into temperature programs for the entire house. The device is not practical for adapting to a residential house.

U.S. Pat. No. 5,949,232 issued Sep. 7, 1999 to Parlante describes a method for measuring the relative energy used by each unit of many units served by a single furnace based on the accumulated time each unit draws energy. The method prorates the total based on time and does not account for different rates of energy use by each unit. The method requires individual timers for each unit and a method for communicating times to a central location. The method does not provide accurate results when each unit draws energy at different rates from the common source, and is not adaptable to a residential zone controlled forced air HVAC system.

U.S. Pat. No. 6,349,883 issued Feb. 26, 2002 to Simmons, et al. describes a control system for a set of zones that draw energy form a common supply. The system claims to save energy using occupant sensors and parameters entered locally in each zone to request conditioning only when the zone is occupied. The system does not have a centralized way to specify and control the zones as groups or as an entire house, and the system is not practical for residential retrofit or use.

U.S. Pat. No. 5,884,384 issued Mar. 23, 1999 to Griffloen describes a method for installing a tube inside another tube using a fluid under pressure. This method is not adaptable to air ducts because air duct are variable size, have irregular bends and corners, and are designed to withstand very small pressure differences.

The prior art individually or in combination does not provide a practical means for providing a zone control system or retrofit to existing HVAC residential buildings and homes. Individual components needed for each room have replicated components that could be shared to reduce cost. Installation of the components requires access and or modification to existing air ducts and changing or modifying objects visible to the occupant of the rooms. The control systems are complex and difficult to control, so the occupants are not able to get full benefit from zone control. The control systems provide no information about the energy used to condition each room nor predictions that help the occupants make informed decisions about comfort versus energy savings. Prior systems provide no means for diagnosing energy usage to identify HVAC equipment or building problems that can be cost-effectively repaired.

OBJECTIVES OF THIS INVENTION

An objective of this invention is an improved zone climate control system that provides better comfort because the temperature in each room is monitored and the airflow through each air duct is controlled by a control processor that also controls the HVAC equipment. In effect, each room has its own thermostat.

Another objective of this invention is an improved zone climate control system that can be practically installed in most existing houses with forced air HVAC systems. Wireless thermometers are used to monitor the temperatures, so power and control wires are eliminated. The air ducts are used as conduits for small pneumatic tubes that control and actuate the airflow control devices. The installation only uses access to the air vents in the rooms and the centrally located discharge plenum. There is no need to access the air ducts, modify the air ducts, or add wires from the thermometers to the control processor.

Another objective of this invention is an improved zone climate control system that is low cost. The invention uses an optimized combination of mature electronics technology, simple mechanics, and software, to reduce the total system cost.

Another objective of this invention is an improved zone climate control system that reduces energy use. Individual rooms can be heated and cooled according to independent minute-by-minute and day-by-day schedules that match occupancy and activity.

Another objective of this invention is an improved zone climate control system that measures the relative energy used to condition each room. This information is used to diagnose insulation and HVAC equipment problems, providing the information needed to make cost-effective decisions about improvements in house or HVAC equipment. This information is also used to predict the change in energy usage caused by a change in the temperature schedule of a room, enabling the occupant to make informed decisions about comfort versus energy usage.

Another objective of this invention is an improved zone climate control system that the house occupants find easy to use. An intuitive, graphical application running on personal data assistant (PDA such as a Palm) or a personal computer is used to specify the temperature schedules for each room for each day, and to specify the function assigned to a push button on the wireless thermometers. Other push buttons on the thermometers provide simple methods for the most common adjustments such as temporarily changing the room temperature.

SUMMARY OF INVENTION

Briefly described, this invention is an improved zone climate control system for installation in existing residential forced air HVAC systems. The system is low cost and installation is quick, easy, and non-intrusive. The system provides independent room-by-room, minute-by-minute, and day-by-day temperature control. Pneumatic airflow control devices are installed in each air vent and the controlling air tubes are pulled through the existing air ducts to the central discharge plenum so that the air ducts are not accessed, disassembled, or modified in any other way during installation. Battery powered wireless thermometer devices are placed in each room to report the local temperature and provide programmable one-button functions for controlling temperatures. A control processor mounted on the plenum controls the existing HVAC equipment and airflow control devices while monitoring plenum pressure and plenum temperature to control the temperature in each room following temperature schedules assigned to the rooms. A PDA or PC application is used to specify and assign minute-by-minute temperature schedules to each room for each day. The relative energy used to condition each room is stored and displayed so that the occupant can make informed decisions between comfort and energy savings, and identify correctable problems with the HVAC equipment or house insulation.

BRIEF DESCRIPTION OF DRAWINGS

FIG. 4 illustrates the method for mounting a bladder in an air duct.

FIG. 11 is a detailed diagram of the pressure and vacuum relief valves.

FIG. 12 illustrates a wireless thermometer device and the thermometer data message.

FIG. 13 illustrates the radio receiver that receives thermometer data messages and the method for measuring signal strength.

FIG. 24 is a high level flow diagram of the control processor program.

FIG. 25 is a listing of the main data structure used by the control processor program.

DETAILED DESCRIPTION

Figure 1:
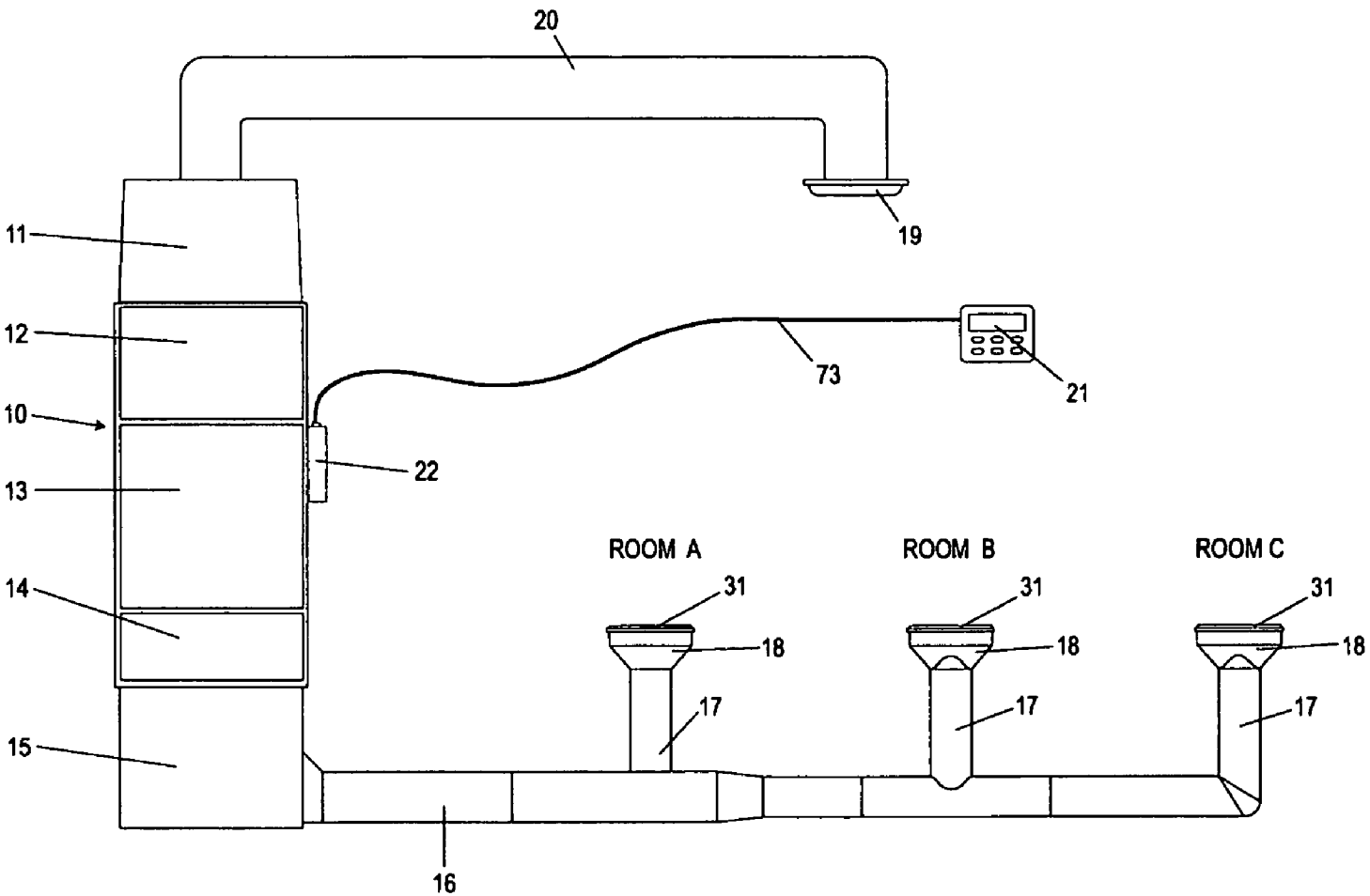
FIG. 1 is a block diagram of a typical forced air residential HVAC system.

FIG. 1 is a block diagram of a typical forced air system. The existing central HVAC unit 10 is typically comprised of a return air plenum 11, a blower 12, a furnace 13, an optional heat exchanger for air conditioning 14, and a conditioned air plenum 15. The configuration shown is called "down flow" because the air flows down. Other possible configurations include "up flow" and "horizontal flow". A network of air duct trunks 16 and air duct branches 17 connect from the conditioned air plenum 15 to each air vent 18 in room A, room B, and room C. Each air vent is covered by an air grill 31. Although only three rooms are represented in FIG. 1, the invention is designed for larger houses with many rooms and at least one air vent in each room. The conditioned air forced into each room is typically returned to the central HVAC unit 10 through one or more common return air vents 19 located in central areas. Air flows through the air return duct 20 into the return plenum 11.

The existing thermostat 21 is connected by a multi-conductor cable 73 to the existing HVAC controller 22 that switches power to the blower, furnace and air conditioner. The existing thermostat 21 commands the blower and furnace or blower and air conditioner to provide conditioned air to cause the temperature at thermostat to move toward the temperature set at the existing thermostat 21.

FIG. 1 is only representative of many possible configurations of forced air HVAC systems found in existing houses. For example, the air conditioner can be replaced by a heat pump that can provide both heating and cooling, eliminating the furnace. In some climates, a heat pump is used in combination with a furnace. The present invention can accommodate the different configurations found in most existing houses.

Overview of the System

Figure 2:
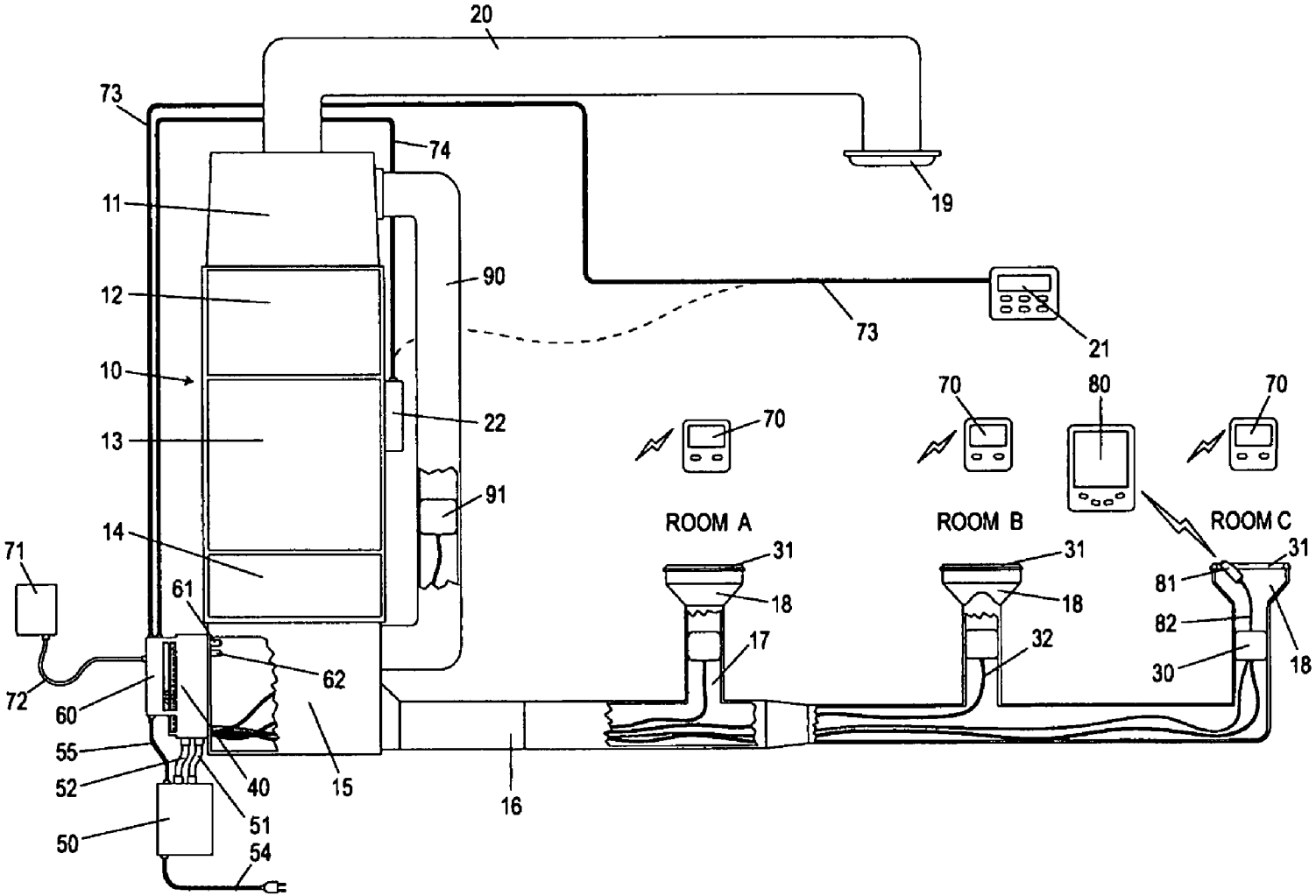
FIG. 2 is a high-level block diagram of the present invention installed in the HVAC system illustrated in FIG. 1.

FIG. 2 is a block diagram of the present invention installed in an existing forced air HVAC system as shown in FIG. 1. The airflow through each vent is controlled by an airtight bladder 30 mounted behind the air grill 31 covering the air vent 18. The bladder is either fully inflated or deflated while the blower 12 is forcing air through the air duct 17. A small air tube 32 (~0.25" OD) is pulled through the existing air ducts to connect each bladder to one air valve of a plurality of servo controlled air valves 40 mounted on the side of the conditioned air plenum 15. There is one air valve for each bladder. A small air pump in air pump enclosure 50 provides a source of low-pressure (~1 psi) compressed air and vacuum at a rate of ~1.5 cubic feet per minute. The pressure air tube 51 connects the pressurized air to the air valves 40. The vacuum air tube 52 connects the vacuum to the air valves 40. The air pump enclosure 50 also contains a 5V power supply and control circuit for the air pump. The AC power cord 54 connects the system to 110V AC power. The power and control cable 55 connect the 5V power supply to the control processor and servo controlled air valves and connect the control processor 60 to the circuit that controls the air pump. The control processor 60 controls the air valve servos 40 to set each air valve to one of two positions. The first position connects the compressed air to the air tube so that the bladder inflates. The second position connects the vacuum to the air tube so that the bladder deflates.

A wireless thermometer 70 is placed in each room in the house. All thermometers transmit, on a shared radio frequency of 433 MHz, packets of digital information that encode 32-bit digital messages. A digital message includes a unique thermometer identification number, the temperature, and command data. Two or more thermometers can transmit at the same time, causing errors in the data. To detect errors, the 32-bit digital message is encoded twice in the packet. The radio receiver 71 decodes the messages from all the thermometers 70, discards packets that have errors, and generates messages that are communicated by serial data link 72 to the control processor 60. The radio receiver 71 can be located away from the shielding effects of the HVAC equipment if necessary, to ensure reception from all thermometers.

The control processor 60 is connected to the existing HVAC controller 22 by the existing HVAC controller connection 74. The control processor 60 interface circuit uses the same signals as the existing thermostat 21 to control the HVAC equipment. The existing thermostat connection 73 is also connected to the control processor 60 interface circuit that includes a manual two position switch. In the first switch position, the HVAC controller 22 is connected to the control processor 60. In the second switch position, the HVAC controller is connected to the existing thermostat 21. The existing thermostat 21 is retained as a backup temperature control system.

The control processor 60 controls the HVAC equipment and the airflow to each room according to the temperature reported for each room and according to an independent temperature schedule for each room. The temperature schedules specify a heat-when-below-temperature and a cool-when-above-temperature for each minute of a 24-hour day. A different temperature schedule can be specified for each day for each room. These temperature schedules are specified by the occupants using an interface program operating on a standard PDA (personal data assistant) 80. PDAs are available from several manufacturers such as Palm. The interface program provides graphical screens and popup menus that simplify the specification of the temperature schedules and the assignment of schedules to rooms for the days of the week and for other special dates. The PDA 80 includes a standard infrared communications interface called IrDA that is used to communicate with the control processor 60. The IrDA link 81 is mounted in the most convenient air vent 18, behind its air grill 31. The IrDA link 81 has an infrared transmitter and receiver mounted so that it can communicate with the PDA 80 using infrared signals though the air grill. The IrDA link 81 is connected to the control processor 60 by the link connection 82 that is pulled through the air duct with the air tube to that air vent. After changes are made to the temperature schedules, the PDA 80 is pointed toward the IrDA link 81 and the standard IrDA protocol is used to exchange information between the PDA 80 and the control processor 60.

The IrDA link 81 also has an audio alarm and light that are controlled by the control processor 60. The control processor can sound the alarm and flash the light to get the attention of the house occupants if the zone control system needs maintenance. The PDA 80 is used to communicate with the control processor 60 to determine specific maintenance needs.

The present invention can set the bladders so that all of the airflow goes to a single air vent, thereby conditioning the air in a single room. This could cause excessive air velocity and noise at the air vent and possibly damage the HVAC equipment. This is solved by connecting a bypass air duct 90 between the conditioned air plenum 15 and the return air plenum 11. A bladder 91 is installed in the bypass 90 and its air tube is connected to an air valve 40 so that the control processor can enable or disable the bypass. The bypass provides a path for the excess airflow and storage for conditioned air. The control processor 60 is interfaced to a temperature sensor 61 located inside the conditioned air plenum 15. The control processor monitors the conditioned air temperature to ensure that the temperature in the plenum 15 does not go above a preset temperature when heating or below a preset temperature when cooling, and ensures that the blower continues to run until all of the heating or cooling has been transferred to the rooms. This is important when bypass is used and only a portion of the heating or cooling capacity is needed, so the furnace or air conditioner is turned only for a short time. Some existing HVAC equipment has two or more heating or cooling speeds or capacities. When present, the control processor 60 controls the speed control and selects the speed based on the number of air vents open. This capability can eliminate the need for the bypass 90.

A pressure sensor 62 is mounted inside the conditioned air plenum 15 and interfaced to the control processor 60. The plenum pressure as a function of different bladder settings is used to deduce the airflow capacity of each air vent in the system and to predict the plenum pressure for any combination of air valve settings. The airflow to each room and the time spent heating or cooling each room is use to provide a relative measure of the energy used to condition each room. This information is reported to the house occupants via the PDA 80.

This brief description of the components of the present invention installed in an existing residential HVAC system provides an understanding of how independent temperature schedules are applied to each room in the house, and the improvements provided by the present invention. The following discloses the details of each of the components and how the components work together to proved the claimed features.

Inflatable Bladders Used for Airflow Control Devices

Figure 3:
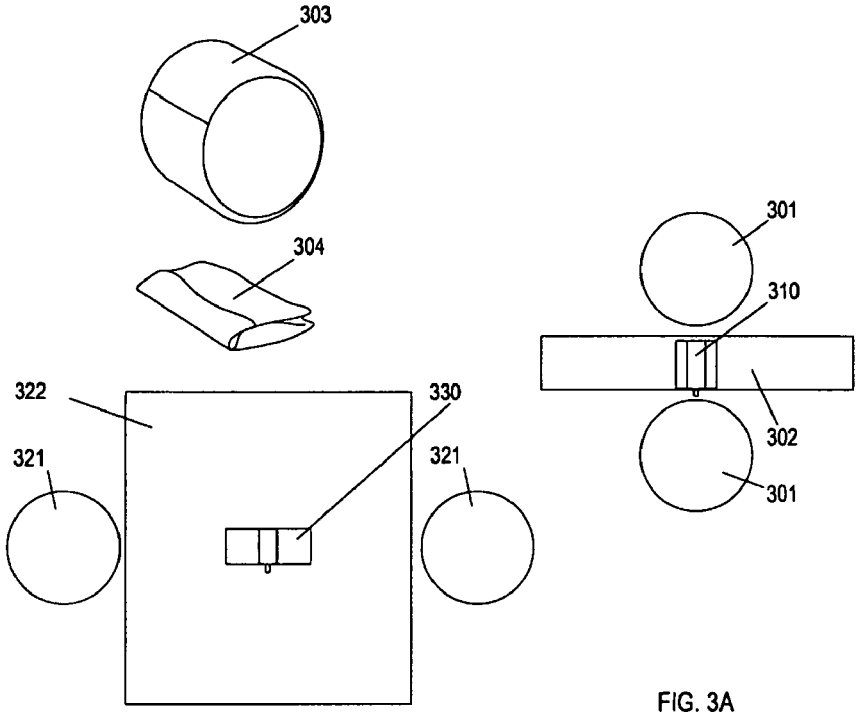
FIG. 3 illustrates inflatable air bladders used as airflow control devices.
Figure 3A:
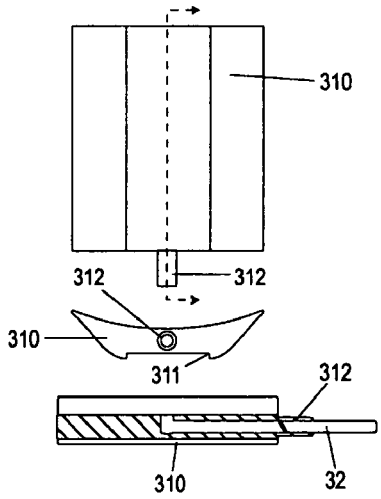

FIG. 3 is a diagram showing the construction of the bladders 30 used as airflow control devices. The bladders are constructed of flexible thin plastic or fabric coated with an airtight flexible sealer. The material is approved by UL or another listing agency for use in plenums. The bladders for controlling airflow in round air ducts are cylinders made by seaming together two circular shapes 301 and a rectangular shape 302. Depending on the material, the airtight seams are heat sealed or glued. The material is only slightly elastic so the inflated size is determined by the dimensions of these shapes. An air tube connector 310 is sealed to the rectangular shape 302. The air tube connector is molded from flexible plastic approved for use in plenums. FIG. 3A shows more detail of the air tube connector 310, which has an air tube socket 312 sized so that it tightly grips the outside of the air tube 32. The air tube connector provides the air path from the air tube to the inside of the bladder. The air tube connector is contoured to match the curvature of the round air duct and has a notch 311 to fit a mounting strap. This shape prevents conditioned air from leaking around the bladder when it is inflated. The inflated bladder 303 is about 110% the diameter of the air duct and its height is about 75% of the diameter. When inflated in the duct, the cylinder wall is pressed firmly against the inside of the air duct, effectively blocking all airflow. The deflated bladder 304 presents a small cross-section to airflow and restricts airflow by less than 10%. The standard round duct sizes connecting to air vents in residential installations are 4", 6", and 8". Bypass 90 can be 6", 8", or 10" in diameter. A total of only 4 different round duct bladder sizes are needed for residential installations.

Figure 3B:
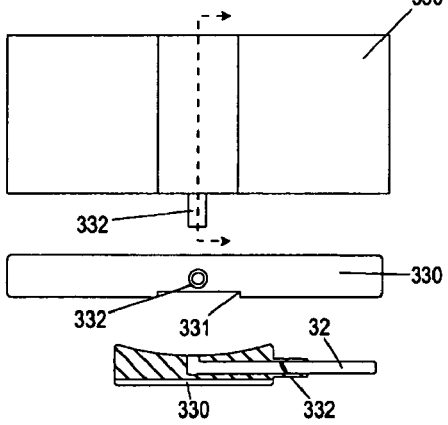

The bladders for controlling airflow in rectangular ducts are also cylinders made by seaming together two circular shapes 321 and a rectangular shape 322. The cylinder is oriented so that the axis of the cylinder is parallel to the widest dimension of the duct. The height of the cylinder is about 110% of the wider dimension of the duct. The cylinder diameter is at least 110% of the narrower dimension of the duct, but can be as much as 200%. When inflated, the bladder accepts only enough air to fill the air duct. FIG. 3B shows more detail of the air tube connector 330, which is contoured for the flat surface of the rectangular duct and it has a notch 331 to fit a mounting strap and air tube socket 332 sized to fit the outside of the air tube 32.

FIG. 4 shows several views of the method for mounting the bladder 30 in an air duct 17 at an air vent 18 covered by air grill 31. Referring to FIG. 4E, the air tube 32 is inserted into the air tube socket 312 in the air tube connector 310 sealed to the bladder 30 shown with the top portion cut away. Mounting clamp 402 compresses the air tube socket around the air tube.

FIG. 4C is a plain view of the mounting strap, which is made from thin metal (18 gauge) and is approximately 1" by 12". Hole 407 is used to secure the air tube to the mounting strap. One pair of holes 406 are used to secure the mounting clamp 402 to the mounting strap. Two of the holes 408 are used to secure the mounting strap to the inside of the air vent or air duct at the air vent.

FIG. 4D is a perspective drawing showing the mounting clamp 402 connecting to the mounting strap 401. The mounting clamp straddles the air tube socket 312 (shown in FIG. 4E) and two bladder clamp screws 405 pass through holes 406 in the mounting strap and screw into the mounting clamp. Several pairs of holes 406 (shown in FIG. 4C) are provided so the bladder can be positioned for the most effective seal of the air duct. The screws 405 are self-tapping with flat heads that match counter-sinks pressed into the holes 406 in the mounting strap. Tightening the bladder clamp screws 405 cause the bladder clamp 402 to compress the air tube socket 312 firmly around the air tube 32, securing the bladder to the mounting strap and ensuring an air tight seal between the air tube and the bladder. When tightened, the screw heads are flat with the bottom surface of the mounting strap, and the mounting strap fits in the notch 311 of the air tube connector 310 so the mounting strap is flat with the air tube connector.

FIG. 4F is a cross-section view of the assembled bladder installed in an air duct 17 connecting to air vent 18 covered by air grill 31. The air tube 32 is secured to the mounting strap 401 by the air tube clamp 403 (also shown in FIG. 4D) using a screw 409 and nut through hole 407 (shown in FIG. 4C). The air tube clamp transfers any tension on the air tube to the mounting strap and prevents strain on the connection between the air tube and the bladder. The mounting clamp 402 is connected to the mounting strap by two screws 405 and compresses the air tube socket 312 and secures the bladder 30 to the mounting strap. The mounting strap is secured to the inside of the air duct or air vent by two screws 404 through holes 408 (shown in FIG. 4C). Some air vents are constructed with in integrated section of air duct several inched long, which fits inside the connecting air duct 17. The inflated bladder can make contact with this extension of the air vent or it can make contact in the air duct when the extension is not part of the air vent.

FIG. 4A is an exploded perspective view of the assembled bladder 30 and mounting strap 401 fitting into the air duct 17 connected to air vent 18. The inside of the air duct or air vent 410 where the bladder makes contact must be a smooth surface. If sharp sheet metal edges or screws are present, they are cut or smoothed and covered with duct mastic or duct tape to form a smooth surface and contour.

FIG. 4B is an exploded perspective view of an assembled bladder and air tube secured to amounting strap 401 for mounting inside a rectangular air duct 411.

All installation and assembly work is done in the room where the air vent is located. The air grill is removed and an air tube 32 is pulled from the air vent to the plenum 15. The air tube is secured to the mounting strap 401 and the proper size and shape bladder 30 is secured to the mounting strap. The inside surface 410 of the air vent or air duct is prepared by smoothing, cutting, or covering sharp edges and screws. In many cases, no preparation is required. This surface is chosen so it is close enough to the front of the air vent to provide convenient access for any surface preparation work. The mounting strap is inserted into the air vent and the mounting strap is bent and position so the inflated bladder meets the surface 410. The mounting strap is then secured to the inside of the air vent by one or two sheet metal screws. The air grill is then reinstalled. After installation, the bladder is hidden by the air grill, and there are no visible signs of installation. The installation requires no other modification to the air duct, air vent, or air grill, and no other access to the air duct is required.

Servo Controlled Air Valves

Figures 5, 5A, 5B, 5C, 5D, 5E:
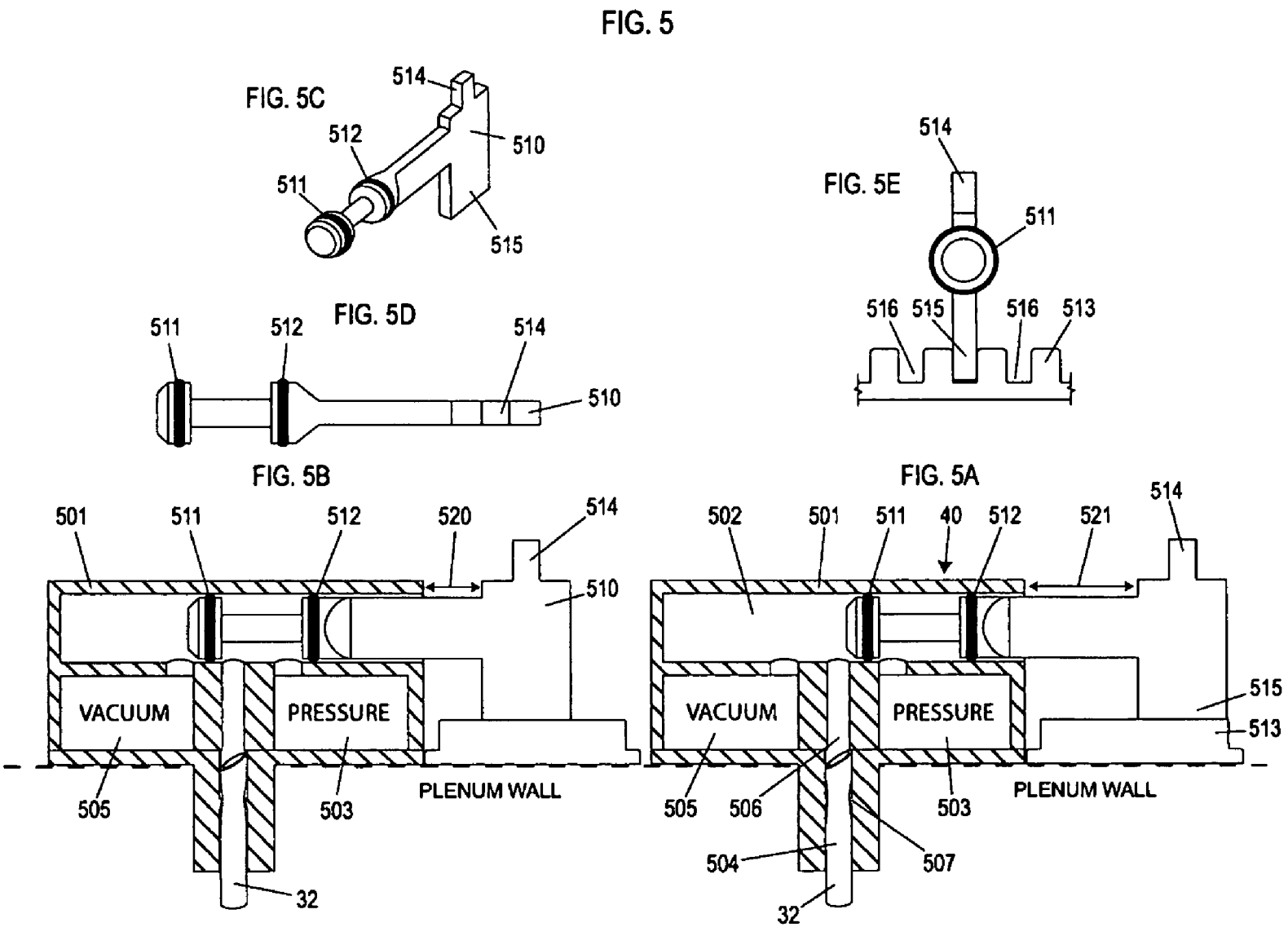
FIG. 5 is a cross-section drawing of one air valve of a plurality of servo-controlled air valves.

FIG. 5 shows several views of one air valve of a plurality of servo controlled air valves 40. The preferred embodiment has two valve blocks made of plastic using injection molding. Each valve block is approximately 1"×2"×7" and contains valve cylinders for 12 valves.

FIG. 5A is a cross section view of one valve block 501 sectioned through one of the valve cylinders 502. Each valve cylinder is 0.375" in diameter and approximately 1.875" deep. Each valve cylinder has three holes (~0.188") that connect the cylinder to the pressure cavity 503, the valve header 504 (shown in cross section), and the vacuum cavity 505. The valve header 504 connects the air tube 32 (shown in full view) to the valve cylinder and provides one side of the pressure and vacuum cavities in the valve block. The valve header is made of plastic using injection molding and is glued to the valve block to form airtight seals. The air tube 32 is press fit into the air tube hole 506 in the valve header. The inside of the air tube hole has a one-way compression edge 507 making it difficult to pull the air tube from the header after it has been inserted. The valve block is mounted on a side of the conditioned air plenum 15 so that the portion of valve header 504 connecting to the air tube is inside the plenum and the portion of the valve header sealing the pressure and vacuum cavities and the valve block 501 are outside the plenum.

FIG. 5C is a perspective view of the valve slide 510 and FIG. 5D is a top view of the same valve slide. The valve slide has grooves for O-ring 511 and O-ring 512. The valve slide has a valve lever 514 that protrudes above the valve plate 515. The valve lever is used to move the valve slide inside the valve cylinder.

FIG. 5A and FIG. 5B represent the same air valve in two different positions. The valve slide 510 (shown in full view) fits snugly inside the valve cylinder 502 so that the O-rings seal the cavities formed by the cylinder wall and the valve slide. The slide valve has two resting positions, the pressure position 520 shown in FIG. 5B and the vacuum position 521 shown in FIG. 5A. The air pump 50 is turned on only when the valves are in one of these two positions. The air pump is off while the valves are moved. Referring to FIG. 5B, when the slide valve is in the pressure position 520, O-ring 511 seals the vacuum cavity and the valve cylinder from the air tube. The cavity formed between O-ring 511 and O-ring 512 connects the pressure cavity to the air tube so pressurized air will flow through the air tube to inflate the bladder. O-ring 512 seals the valve cylinder from the outside air. Referring to FIG. 5A, when the slide valve is in the vacuum position 521, the vacuum cavity is connected to the air tube and O-ring 511 seals the vacuum cavity from the pressure cavity. The bladder is deflated as air flows through the air tube towards the vacuum created by the air pump. O-ring 511 and O-ring 512 seal the pressure cavity from the air tube and outside air. The valve slide is moved to either the pressure position 520 or the vacuum position 521 by a servo that engages the valve lever 514.

FIG. 5E shows an end view of a valve slide as positioned when in a valve cylinder. The valve lever 514 and valve plate 515 are constrained from rotating about the valve cylinder axis by a slot 516 in the valve constraint 513. The valve constraint has a slot 516 for each valve slide. FIG. 5A also shows a side view of the valve plate 515 and the valve constraint 513.

Figures 6, 6A, 6B, 6C, 6D, 6E, 6F:
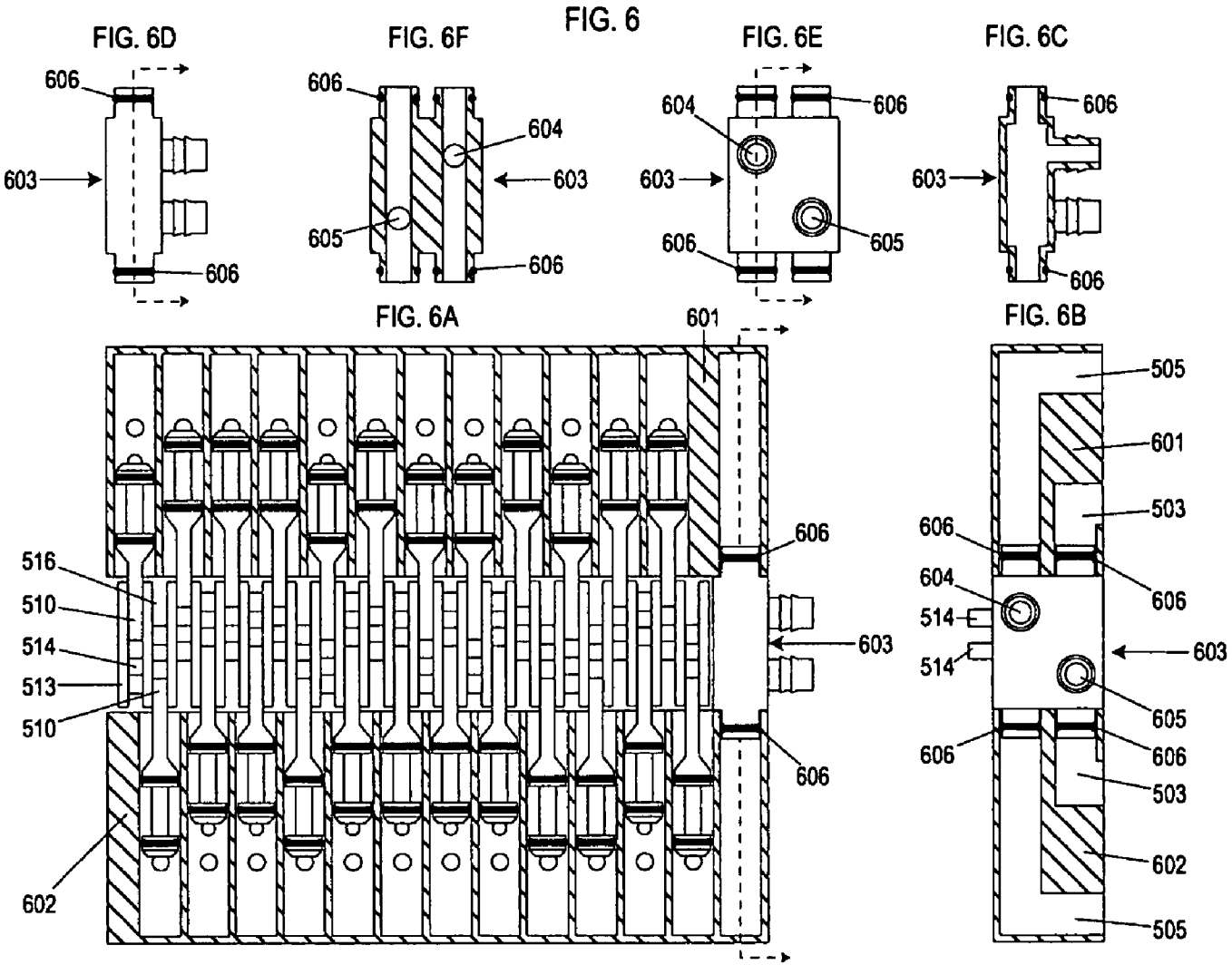
FIG. 6 is a cross-section drawing of two blocks of air valves and a connecting air-feed tee.

FIG. 6 shows several views of the two valve blocks 601 and 602 and air-feed tee 603.

FIG. 6A is a cross-section view through the axis of the valve cylinders of valve block 601 and valve block 602 positioned so that the valve slides 510 (shown in full view) are interleaved. Interleaving minimizes the spacing between valve slides and aligns the valve levers 514 so the valve servo can move the valve slides in valve blocks 601 and 602. Some of the valve slides are shown in the pressure position and the others are shown in the vacuum position. The valve constraint 513 has 24 slots 516 that engage the 24 valve slide plates to prevent rotation of the valve slides about the valve cylinder axis. The ends of the valve blocks 601 and 602 have passageways from the pressure and vacuum cavities to the air-feed tee 603. O-rings 606 seal the connections between the air-feed tee and these passageways.

FIG. 6B is an end cross-section view through the section line shown in FIG. 6A of the passageways in the valve blocks 601 and 602 to the pressure cavities 503 and vacuum cavities 505. The air-feed tee 603 is shown in full view. Four O-rings 606 seal the air-feed tee to the valve blocks. The air-feed tee has a vacuum connection 604 that connects to the vacuum air tube 52 and a pressure connection 605 that connects to the pressure air tube 51. The valve levers 514 protrude beyond the surface of the valve blocks.

FIG. 6D is a top view of the air-feed tee 603 and o-rings 606 in isolation from the valve blocks. FIG. 6C is a cross-section view (through the section line shown in FIG. 6E) of the air-feed tee and the vacuum connection 604. FIG. 6E is a front view of the air-feed tee in isolation. FIG. 6F is a cross-section view (through the section line shown in FIG. 6D) of the air-feed tee through the center of the passageways connecting to the pressure and vacuum cavities.

Figure 7:
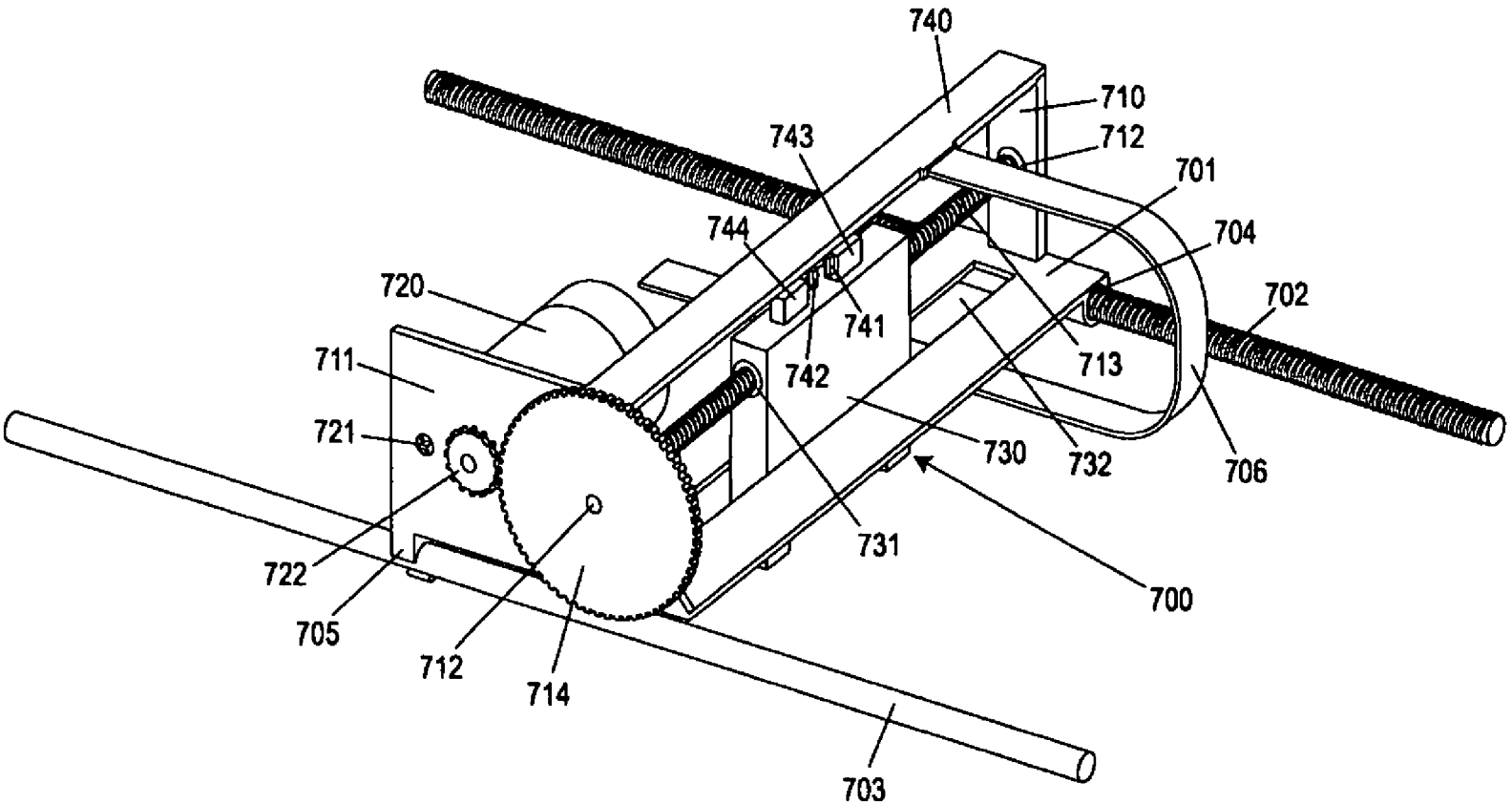
FIG. 7 is a perspective drawing of the valve servo.

FIG. 7 is a perspective drawing of the valve servo 700. The servo carriage 701 is made of injection molded plastic. The servo carriage is supported by the position threaded rod 702 and the slide rod 703. In the preferred embodiment, the position threaded rod is ⅜" in diameter and has 16 threads per inch. The servo carriage has a position threaded bearing 704 that engages the position threaded rod. The position threaded bearing may be a threaded hole machined in the valve carriage plastic, or may be a threaded metal cylinder press fit into a hole in the servo carriage. The fit between the position threaded rod and the position threaded bearing is loose so there is minimum friction as the threaded rod rotates to move the servo carriage. The interface between the threaded rod and the threaded bearing provides support and constraint for the servo carriage for all directions except rotation about the axis of the threaded rod. Rotation constraint is provided by the smooth slide rod 703 that engages the carriage guide 705. The fit between the slide rod and the carriage guide is loose so there is minimum friction as the carriage is moved by rotation of the position threaded rod.

The servo carriage has a bearing post 710 and a bearing plate 711 that support the two valve bearings 712. The valve bearings are press fit into holes molded in the bearing post and bearing plate. The valve threaded rod 713 is a standard #8 sized screw with 32 threads per inch. The ends of the valve threaded rod are machined to fit the valve bearings so the rod can rotate with minimum friction and constrained so it can not move in any other way. The valve drive spur gear 714 is approximately 1" in diameter and is fastened to the end of the valve threaded rod.

The valve motor 720 is mounted on the bearing plate 711 by two screws 721 (one screw 721 is hidden by spur gear 714) that pass through the bearing plate into the end of the motor. The valve motor spur gear 722 is approximately 3/16" in diameter and is fastened to the shaft of the valve motor. The valve motor is positioned so that the valve motor spur gear engages the valve drive spur gear. The valve motor operates on 5 volts DC using approximately 0.3 A. It rotates CW or CCW depending on the direction of current flow. The control processor 60 has an interface circuit that enables it to drive the valve motor CW or CCW at full power. The control is binary on or off. The valve motor, valve motor spur gear, and valve drive spur gear are chosen so that the valve threaded rod rotates approximately 1000 RPM when the valve motor is driven.

The servo slider 730 has a slider threaded bearing 731 that engages the valve threaded rod 713. The servo slider is supported by the valve threaded rod and is constrained by the threaded rod in all directions except rotation about the axis of the threaded rod. The servo slider passes through the slider slot 732 in the servo carriage. The slider slot constrains the servo slider so that as the valve threaded rod rotates, the servo slider can only move parallel to the axis of the slot and the axis of the valve threaded rod. The fit between the servo slider and the slider slot is loose to minimize friction as the slider moves.

The bearing post 710 and bearing plate 711 also support the valve PCB (printed circuit board) 740. The valve PCB connects to a 6-conductor flat flexible cable 706 that connects to the interface circuit of the control processor 60. Two wires from the valve motor connect to PCB 740 and to two conductors in the flexible cable. The valve PCB supports the A-photo-interrupter 741 and the B-photo-interrupter 742. The photo-interrupters are positioned so that A-slider tab 743 and B-slider tab 744 on the servo slider 730 pass through the photo-interrupters as the servo slider is moved by the valve motor and valve threaded rod. The photo-interrupters generate binary digital signals that encode three positions of the of the servo slider. These digital signals are connected to the control processor through the flexible cable and are used by the control processor when driving the valve motor to position the servo slider.

Figures 8, 8A, 8B, 8C:
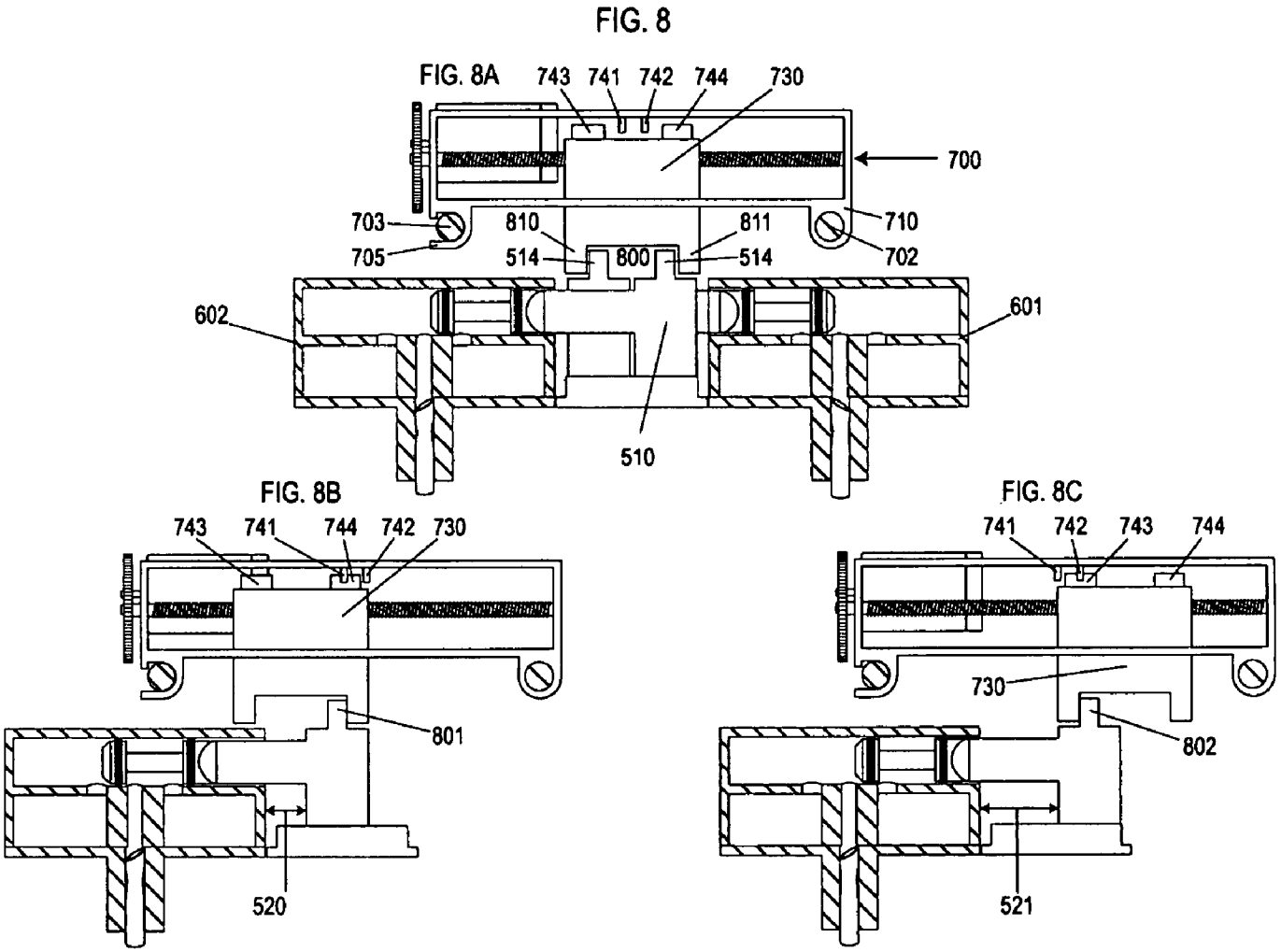
FIG. 8 is a cross-section drawing of the valve servo positioned over one of the air valves.

FIG. 8 shows three views of the valve servo positioned over the valve blocks. FIG. 8A shows the valve blocks 601 and 602 in cross-section with the valve servo 700 positioned over one of the valve slides 510 in valve block 602. The position of the valve servo is established by the position threaded rod 702, position threaded rod bearing 704, slide rod 703, and carriage guide 705. The servo slider 730 is shown in the center position 800. A-slider finger 810 and B-slider finger 811 have about 1/16" clearance from any of the valve levers 514 in either the pressure position 520 or the vacuum position 521. Both valve sliders are shown in the vacuum position. The A-photo-interrupter 741 and the B-photo-interrupter 742 are positioned so that neither the A-slider tab 743 nor the B-slider tab 744 interrupt the light path in the photo-interrupters when the servo slider is in the center position 800. This is the only position where both photo-interrupters are uninterrupted.

FIG. 8B shows the servo slider in the B-position 801 corresponding to the pressure position 520 of the valve slide. In this position, the B-slider tab 744 interrupts the A-photo-interrupter 741 while the light path of the B-photo-interrupter is uninterrupted. When moving from the center position 800 to the B-position, both photo-interrupters are interrupted by the B-slider tab. To move the valve to the B-position, the control processor drives the valve motor until the light path of the B-photo-interrupter is uninterrupted. To return to the center position 800, the valve motor direction is reversed and driven until both photo-interrupters are uninterrupted.

FIG. 8C shows the servo slider in the A-position 802 corresponding to the vacuum position 521 of the valve slide. In this position, the A-slider tab 743 interrupts the B-photo-interrupter 742 while the light path of the A-photo-interrupter 741 is uninterrupted. When moving from the center position 800 to the A-position, both photo-interrupters are interrupted by the A-slider tab. To move the valve to the A-position, the control processor drives the valve motor until the light path of the A-photo-interrupter is uninterrupted. To return to the center position 800, the motor direction is reversed and driven until both photo-interrupters are uninterrupted.

When the control processor begins operation, the position of the valve servo is unknown, and must be initialized. The valve servo is initialized first by testing the signals from the A- and B-photo-interrupters. If both are uninterrupted, then the valve servo is in the center position 800 and properly initialized. Any other combination of signals from the photo-interrupters represents one of two possible positions.

If both photo-interrupters are interrupted, then either the A-slider tab 743 or the B-slider tab 744 is interrupting the light paths. For this case, the servo slider is driven towards the B-position 801 until the B-photo-interrupter becomes uninterrupted. The servo slider either is in the B-position or is just right of the center position. After a pause for the valve motor to come to a stop, the servo slider is driven towards the B-position again. If the A-photo-interrupter becomes uninterrupted within a short time, the servo slider is in the center position, and the valve servo is initialized. If the A-photo-interrupter remains interrupted, then the servo slider is jammed in the B-position and must be driven towards the A-position until both photo-interrupters are uninterrupted.

If initially only the A-photo-interrupter is interrupted, then the servo slider either is in the B-position 801 or is slightly right of the center position. The servo slider is driven towards the B-position and if the A-photo-interrupter becomes uninterrupted within a short time, the servo slider is in the center position, and the valve servo is initialized. If the A-photo-interrupter remains interrupted, then the servo slider is jammed in the B-position and must be driven towards the A-position until both photo-interrupters are uninterrupted.

If initially only the B-photo-interrupter is interrupted, then the servo slider either is in the A-position 802 or is slightly left of the center position. The servo slider is driven towards the A-position and if the B-photo-interrupter becomes uninterrupted within a short time, the servo slider is in the center position, and the valve servo is initialized. If the B-photo-interrupter remains interrupted, then the servo slider is jammed in the A-position and must be driven towards the B-position until both photo-interrupters are uninterrupted.

Figure 9:
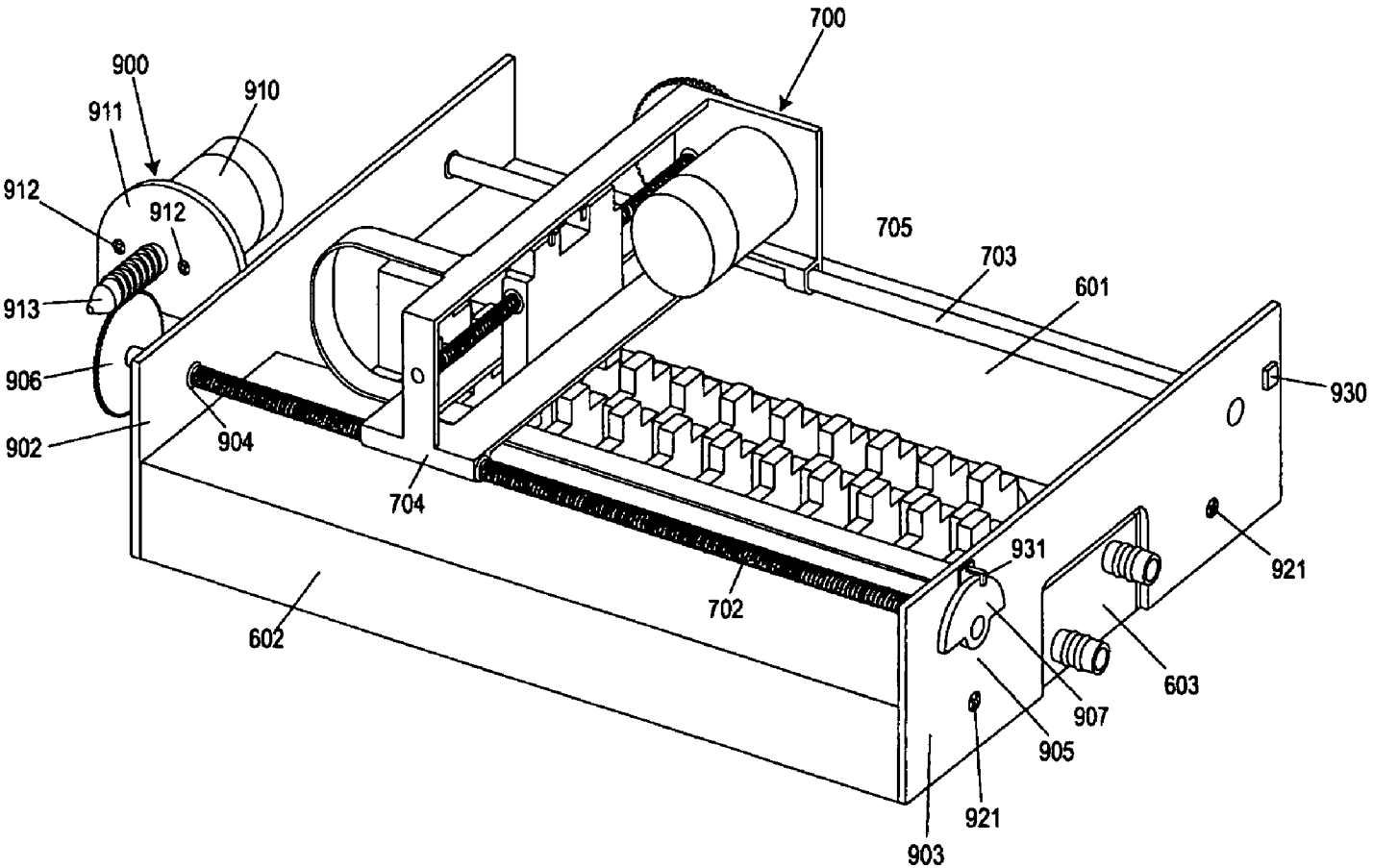
FIG. 9 is a perspective drawing of the position servo.

FIG. 9 is a perspective drawing of the position servo 900 assembled with valve block 601 and valve block 602. The position bearings 904 and 905 are press fit into holes in the motor bracket 902 and bearing bracket 903. The position threaded rod 702 is machined to fit in the bearings and to constrain the threaded rod so that the only possible movement is rotation. The threaded rod is also machined so that the rotation cam 907 can be fastened to the end that protrudes beyond position bearing 905 and so that the position spur gear 906 can be fastened to the end that protrudes beyond position bearing 904. The slide rod 703 is press fit into holes in the motor bracket and the bearing bracket. The bearing holes and the slide rod holes are positioned so that the position threaded rod and the slide rod are parallel to each other and to the valve blocks. The position threaded bearing 704 of the valve servo 700 engages the position threaded rod and the carriage guide 705 engages the slide rod 703. The position motor 910 is attached with two screws 912 to the motor plate 911, which is injection molded as part of the motor bracket 902. The position motor is positioned so that the position worm gear 913 engages the position spur gear 906.

Motor bracket 902 is attached to the valve block using screws. The motor bracket has molded spacers in line with the screw holes so that when attached, the motor bracket is perpendicular to the valve blocks and spaced so that the servo slider can be positioned over the air valve closest to the motor bracket. Likewise bearing bracket 903 is attached to the valve blocks using screws 921. The bearing bracket has molded spacers in line with the screw holes so that when attached, the bearing bracket is perpendicular to the valve blocks and spaced so that the servo slider can be positioned over the air valve closest to the bearing bracket. The bearing bracket has a cutout at the bottom center so that the pressure air tube 51 and the vacuum air tube 52 can be attached to the air-feed tee 603. The combination of the motor bracket, bearing bracket, and valve bank 601 and 602 connected together with screws form a rigid structure that is mounted as a single unit.

The position motor operates on 5 volts DC using approximately 0.5 A. It rotates CW or CCW depending on the direction of current flow. The control processor 60 has an interface circuit that enables it to drive the position motor CW or CCW at full power. The control is binary on or off. The EOT (end of travel) photo-interrupter 930 is mounted on the bearing bracket 903 so that the carriage guide 705 interrupts the light path when the valve servo is positioned over the valve slide 510 closest to the bearing bracket. The binary digital signal from the EOT photo-interrupter is interfaced to control processor 60. The rotation photo-interrupter 931 is mounted on the bearing bracket 903 and is positioned so that the rotation cam 907 interrupts the light path about 50% of the time as the position threaded rod rotates. For ½ of a rotation, the light path is interrupted and is uninterrupted for the other part of a rotation. The binary digital signal from the rotation photo-interrupter is interfaced to the control processor.

When the control processor begins operation, the position of the valve servo carriage is unknown and must be initialized. If the EOT photo-interrupter is uninterrupted, the position servo is driven to move the valve servo carriage towards the bearing bracket until the EOT photo-interrupter's light path is interrupted by the carriage guide. The EOT photo-interrupter is positioned so that when the position motor stops, the servo slider 730 is positioned over the valve slide closest to the bearing bracket. If the EOT photo-interrupter is initially interrupted, the exact position of the valve servo carriage is not known. Therefore, the position servo is driven to move the valve servo away from the bearing bracket until the EOT photo-interrupter is uninterrupted. Then the position servo is driven to move the valve servo towards the bearing bracket until the EOT photo-interrupter is interrupted, just as if the EOT photo-interrupter was initially uninterrupted.

After the valve and position servos are initially positioned, the control processor can set the air valves by controlling the position and valve motors. Beginning with the air valve closest to the bearing bracket, the control processor moves the servo slider to either the A-position or the B-position to set the valve slider to the pressure position or the vacuum position. Then the servo slider is returned to the center position. Then the position servo is driven to move the valve servo so it is positioned over the second air valve. The position threaded rod has 16 threads per inch and the valve slides are spaced ¼" center to center. Therefore, four revolutions of the threaded rod move the valve servo a distance equal to the distance between adjacent valve slides. The control processor monitors the rotation photo-interrupter 931 while the position threaded rod rotates, counting the number of transitions from interrupted to uninterrupted. After four such transitions, the position motor is stopped. Then the valve servo is drive to set the next valve, and after returning to the center position, the position motor drives the position threaded rod for four more revolutions. This cycle is repeated until all 24 valves are set. The preferred embodiment of the servo controlled valves requires less then one minute to set the positions of all 24 air valves.

After twenty-four air valves are set, the valve servo is positioned over the air valve closest to the motor bracket. The next time the valves are set, the position servo moves the valve servo toward the bearing bracket. The valve servo position is re-initialized by using the EOT photo-interrupter to set the position for the air valve closest to the bearing bracket. This ensures any errors in counting rotations are corrected every other cycle of setting air valves.

Air Pump and Relief Valves

Figure 10:
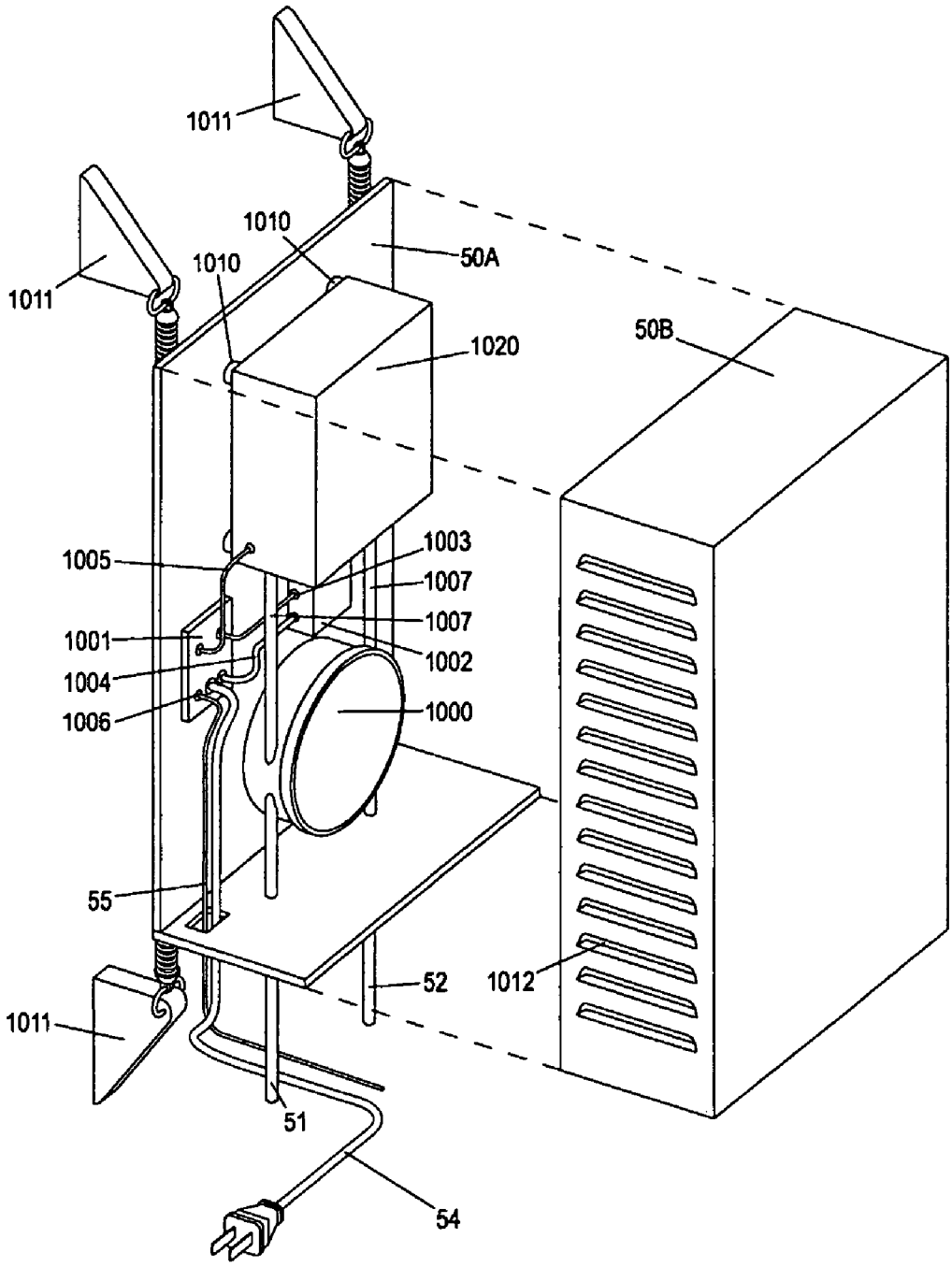
FIG. 10 illustrates the air pump enclosure and its mounting system.

FIG. 10 is a perspective view of the air pump enclosure 50 and its mounting system. The air pump 1020 has a vibrating armature that oscillates at the 60 Hz power line frequency. The preferred embodiment uses pump model 6025 from Thomas Pumps, Sheboygan, Wis. It produces noise that could be objectionable in some installations. The air pump is attached to the enclosure base 50A by four shock absorbing mounting posts 1010. The enclosure base is further isolated by using shock absorbing wall mounts 1011. The enclosure base and enclosure cover 50B are made of sound absorbing plastic to further isolate the noise. The enclosure cover has multiple small ventilation slots 1012.

The pump PCB (printed circuit board) 1001 and the 5V DC power supply 1002 are fastened to the enclosure base 50A. The pump PCB has a standard optically isolated triac circuit that uses a 5V binary signal from the control processor 60 to control the 110V AC power to the air pump. The pump PCB also has terminals to connect the 110V AC power cord 54, the AC supply to 5V power supply 1003, the 5V power from the supply 1004, and the controlled AC supply to the air pump 1005. The 3-conductor power and control cable 55 connects to the pump PCB by connector 1006.

The pressure and vacuum produced by the air pump are unregulated. A pair of diaphragm relief valves 1000 made from injected molded plastic are use to limit the pressure and vacuum to about 1 psi. The relief valves are connected to the air pump by flexible air tubes 1007 to provide noise isolation. The relief valves connect to the pressure air tube 51 and the vacuum air tube 52.

FIG. 11 shows several views of the relief valves 1000. FIG. 11A is a cross-section view through the section line shown in FIG. 1 IC. The main valve structure 1100 is a cylinder made of injection molded plastic. A plate 1101 divides the cylinder into a pressure cavity 1102 and a vacuum cavity 1103. The vacuum feed tube 1104 passes through pressure cavity and an air passage 1106 connects it to the vacuum cavity. Likewise, the pressure feed tube 1105 passes through the vacuum cavity and an air passage 1107 connects it to the pressure cavity. This arrangement enables the pressure feed tube 1105 and the vacuum feed tube 1104 to connect to the ports of the air pump with short and straight tubes.

Referring to FIG. 11A, a thin plastic diaphragm 1110 is glued to the rim of the relief valve structure 1100. The diaphragm has a hole in the center that is covered by the pressure plug 1111. As pressure increases in the pressure cavity 1102, the diaphragm is pushed away from the plug and air leaks from the pressure cavity. The leak increases as the pressure increases so the pressure is regulated. A threaded stud 1112 is mounted in the center of the divider 1101, and the pressure plug is threaded to match the stud. Turning the pressure plug CW or CCW decreases or increases the force between the plug and the diaphragm, thus adjusting the relief pressure. A thin plastic diaphragm 1120 is glued to the rim of the relief valve structure 1100. The diaphragm has a hole in the center that is covered by the vacuum plug 1121. As vacuum increases in the vacuum cavity 1103, the diaphragm is pulled away from the plug and air leaks into the vacuum cavity. The leak increases as the vacuum increases so the vacuum is regulated. A threaded stud 1112 is mounted in the center of the divider 1101, and the vacuum plug is threaded to match the stud. Turning the vacuum plug CW or CCW increases or decreases the force between the plug and the diaphragm, thus adjusting the relief pressure. FIG. 11B is a full end view of the cross-section view shown in FIG. 11A.

FIG. 11C is a bottom view of the relief valves. The pressure air tube 51 connects to the pressure air feed 1105B and the pressure air feed 1105A connects to a flexible air tube 1007 that in turn connects to the pressure output of the air pump 1020. The vacuum air tube 52 connects to the vacuum feed tube 1104B and the vacuum feed tube 1104A connects to a second flexible air tube 1007 that in turn connects to the vacuum input of the air pump.

FIG. 11D is a cross-section view through the section line shown in FIG. 11B of the pressure cavity 1102; Air passage 1107 connects the pressure feed tube 1105 to the cavity. Air passage 1106 connects the vacuum feed tube 1104 to the vacuum cavity 1103.

Wireless Thermometer Devices

FIG. 12A is a perspective view of the wireless thermometer 70 that is placed in each room. Several consumer products provide basic wireless thermometer functions and the techniques are well know to those skilled in the art. The present invention provides additional novel capabilities so that control commands can be entered and displayed at the thermometer. The thermometer is approximately 2"×3" by ¾" and is powered by two AA batteries. The batteries are accessed through a snap-on cover on the back. Mounting bracket 1201 is attached to a vertical surface using a screw through hole 1202 or adhesive. The thermometer has a matching recess that slides into the mounting bracket. When mounted, the thermometer is flush with the mounting surface. The mounting bracket can also be used to mount the thermometer under a horizontal surface such as a table, or the thermometer can be placed on a horizontal surface. Since there are no connecting wires, the thermometer can be placed in any convenient location in the room. Placing the thermometer near the occupants produces the most comfortable results.

The LCD (liquid crystal display) 1200 of the wireless thermometer is comprised of several display areas. The temperature display 1203 shows the current temperature in degrees Fahrenheit at the thermometer. The thermometer has a "Warm" push button 1204, a "Cool" push button 1205, and a "N/S" push button 1207 that are used to enter control commands that are transmitted to the control processor 60 where the commands are executed. The actual behavior of the commands is determined by parameters set in the control processor.

One set of commands specifies temporary temperature changes in the room controlled by the thermometer. The local temperature can be increased or decreased by discrete amounts. The preferred embodiment provides two levels of "warmer" (+2 and +4 degrees) and two levels of "cooler" (−2 and −4 degrees). The display area 1206 displays none or only one of the commands "Warm", "Warmer", "Cool", "Cooler". The commands are selected by pushing the button 1204 or 1205. When no commands are active, all elements of display 1206 are turned off. Pushing the "Warm" button causes the "Warm" element of display 1206 to turn on. Pushing the "Warm" button a second time causes the "Warmer" element to turn on and the "Warm" element to turn off. Additional pushes of 1204 are ignored. When no commands are active, pushing the "Cool" button causes the "Cool" element of display 1206 to turn on. Pushing the "Cool" button a second time causes the "Cooler" element to turn on and the "Cool" element to turn off. Additional pushes of 1205 are ignored. When the "Warmer" display element is turned on, pushing the "Cool" button causes the "Warm" element to turn on and the "Warmer" element to turn off. A second push causes the "Warm" element to turn off so all elements are off. A third push turns on the "Cool" element. Likewise, when the "Cooler" element is on, each push of the "Warm" button causes the display 1206 to sequence through "Cool", none on, "Warm", and "Warmer".

When a temperature command is entered, the thermometer sends the command to the control processor, and the control processor controls the HVAC equipment to cause the temperature change. The thermometer stores the temperature when the command was entered. When the requested change in temperature is achieved, the thermometer turns off the display 1206 and the command is cancelled. The temperature command is temporary to compensate for unusual comfort conditions. When the change is achieved, the room is allowed to return to the temperature specified in its temperature schedule.

A second command entered from the thermometer changes the complete temperature schedule program for the room, a group of rooms, or the whole house. The PDA 80 is used to specify the temperature schedule programs and to associate a "Normal" temperature schedule program and a "Special" temperature schedule program to each thermometer. By default, the "Normal" and "Special" programs are the same, so the change schedule command has no effect. A change schedule command is entered by pressing the "N/S" 1207 push button, which toggles the display area 1208 so that either "Normal" or "Special" is on. For example, if "Normal" is on, pushing the "N/S" push button turns on "Special" and turns off "Normal". Each additional push toggles the display. The selection is fixed until the "N/S" button is pushed again. For example, this command could be programmed to switch the entire house between a normal set of temperature schedules to a vacation schedule that used a minimum of energy. The "N/S" button is pushed once when leaving on vacation to set the "Special" mode, then pressed after returning to select the normal temperature schedules. Only one thermometer need be programmed for this behavior. Other thermometers can be programmed to switch schedules that affect only their assigned room.

All of the thermometers transmit on the same radio channel at 433 MHz using 100% AM modulation to send binary data. Full signal strength represents a binary "one" and the absence of a signal represents a binary "zero". Self-clocking, phase-shift Manchester coding is used to send the data message bit-serially. A "one"-"zero" sequence represents a data bit value of "1" and a "zero"-"one" sequence represents a data bit value of "0". A data packet is composed of a fixed pattern of "one"s and "zero"s followed by 32-bits of encoded data followed by a repeat of the same fixed pattern and the same 32-bits of encoded data. A complete packet requires about 0.3 seconds to transmit. If a radio signal of comparable strength at the same frequency is present when the packet is transmitted, errors will occur because the other signal will mask the "zero" value, which is the absence of a radio signal. Sending the 32-bit data twice in the packet provides robust error detection. After decoding, the receiver compares the two 32-bit values, and if they are not identical, the packet is discarded.

While the 32-bit data remains constant, the thermometer transmits packets at an average rate of one packet per 120 seconds. When the 32-bit data changes, the thermometer transmits at an average rate of one packet per 15 seconds for three minutes. After the 32-bit data is stable for 3 minutes, the average rate is reduced to one packet per 120 seconds. Each thermometer transmits an average of 0.3/120~0.25% of the time when the data is unchanged and 0.3/15~2% of the time for 3 minutes after the data has changed. Although the average time between transmissions is 15 seconds or 120 seconds, each thermometer uses a different pseudorandom process to determine the specific time between successive transmissions. This "randomizes" the transmissions to ensure an equal probability for each thermometer that the shared radio channel is clear when it transmits a packet. With 20 thermometers sharing the same radio channel about 80%–90% of the packets are received without errors. The transmission range in a house is about 100 feet, so systems in adjacent houses may interfere, but thermometers in houses further away will not interfere. Even with 80 thermometers sharing the same radio channel, sufficient packets are received error free to enable the present invention to operate. If necessary, other channels in the 433 MHz band can be used to enable more thermometers to operate in the same area.

FIG. 12B shows the function of each bit in the 32-bit data message 1230. The first bit transmitted is called bit-1 and the last bit is called bit-32. Bit-1 through bit-8 is the ID (identification). The thermometer ID ranges from 0 to 255 and is determined by switch settings inside the thermometer and assigned at installation to a specific room. Bit-9 through bit-20 encodes the centigrade temperature as three digits. A 4-bit BCD (binary coded decimal) code is used to specify digits 0 through 9. Bit-9 through bit-12 encodes BCD0 representing 0.1 degree centigrade, bit-13 through bit-16 encodes BCD1 representing 1 degree centigrade, and bit-17 through bit-20 encodes BCD2 representing 10 degrees centigrade. The encoded range is 0.00 to 99.9. Bit-21 encodes the temperature sign so the total range is −99.9 to 99.9. Although the data is transmitted in centigrade temperature units, the display and other aspects of the present invention use Fahrenheit temperature units. Bit-22 is set to "1" if the batteries are low. Bit-25 through bit-28 encode the temperature commands "Cooler", "Cool", "Warm", and "Warmer". Bit-29 is set to "0" if the "Normal" temperature schedule is selected. Bit-29 is set to "1" if the "Special" temperature schedule is selected. Bit-30 is set to "0" when the slow transmission rate (1 packet per 120 seconds) is used. Bit-30 is set to "1" when the fast transmission rate is used (1 packet per 15 seconds). Bit-31 is set to "1" for 10 minute following a schedule change command ("N/S" button). Bit-31 is set to "0" all other times.

Receiver of Temperature Data

FIG. 13B is a perspective view of the radio receiver 71. It is enclosed in a small plastic box approximately 1"×1.5"×3" with an adjustable antenna 1300 on one end. The receiver is mounted to a wall or ceiling using a screw through mounting hole 1301. It is connected to the control processor by a 4-conductor flat telephone wire 72 using a standard RJ-45 plug and jack 1302. Two conductors are used for the 5V and ground supply and one conductor is used to send serial data to the control processor 60.

FIG. 13A is a schematic diagram of the radio receiver 71. It is comprised of a standard commercial 433 MHz integrated receiver module 1310 with attached antenna 1311. The receiver has a digital output 1312 that decodes the presence of a signal as "one" and the absence of a signal as "zero". The digital output is connected to input 1314 of programmable microprocessor 1313. In the preferred embodiment, the microprocessor is part number PIC12C508 manufactured by Microchip Technology Inc., Chandler Ariz. The microprocessor is programmed to decode the phase-shift Manchester coding, compare the two 32-bit data messages and if identical, send a bit-serial data message through output 1315 to the control processor via the cable 72.

The receiver must be placed so that data packets from all thermometers are received reliably. The radio receiver measures the signal strength of each received packet and encodes a measure of the signal strength as an 8-bit value. The receiver module has an analog output 1316 that is amplified by a standard op-amp 1320. In the preferred embodiment, the op-amp is an LM358 manufactured by National Semiconductor, Santa Clara Calif. The ratio 13R2/13R1 of resistors 13R1 and 13R2 is selected so that the peak-to peak output 1321 of the op-amp is about ½ full scale (2.5V) for a signal of acceptable strength. When the digital output 1322 from the microprocessor is "1" (5V), the resistors 13R3 and 13R4 bias the op-amp so its output is about ⅔ full scale (3.3V). Diode 13D1 in combination with resistor 13R5 and capacitor 13C1 form a peak detector and filter for the signal 1321. The **13R5*13C1 time constant is about 100 microseconds. The peak detector is connected to input 1325 of the microprocessor. Input 1325 has a threshold voltage of about 2 volts, so the microprocessor reads "1" if the voltage is above 2 volts and reads "0" if the voltage is below 2 volts. The microprocessor sets output 1322 to "1" (5V) when receiving packets and the input 1325 follows the peak signal. Since the output of the op-amp is biased above the threshold of the 1325 input, the microprocessor will always read "1" while receiving data. When the microprocessor receives a valid 32-bit message, the output 1322 is set to "0" (0V). This causes the op-amp output to be 0V and the peak detector discharges towards 0V with a time constant of 13R5*13C1. The microprocessor digitally encodes the peak signal strength by measuring the time it takes for the digital input 1325** to cross the threshold so the microprocessor reads "0".

FIG. 13C is a voltage versus time graph for four signals. Graph 1330 illustrates a strong signal at op-amp output 1321 and the corresponding peak detector voltage graph 1331 at the microprocessor input 1325. For this case, it requires time t2 for signal 1331 to cross the 2V threshold. The voltage graph 1332 shows a weak signal and voltage graph 1333 shows the corresponding peak detector signal. For this case, it requires time t1 for signal 1333 to cross the 2V threshold. The microprocessor continuously adds "1" a counter while testing the input 1325. When 1325 becomes "0", the value of the counter is the measure of the signal strength. The digital output 1322 is then set to "1" so the peak detector again tracks the strength of the received signal. The 8-bit encoded value for the signal strength and the 32-bit data message received from the thermometer are sent to the control processor as five 8-bit bytes using a standard serial UART protocol at 1200 bits per second. The signal strength information is used during installation to ensure each signal has sufficient strength to be reliable and also monitored during operation for maintenance purposes.

Control Processor

Figure 14:
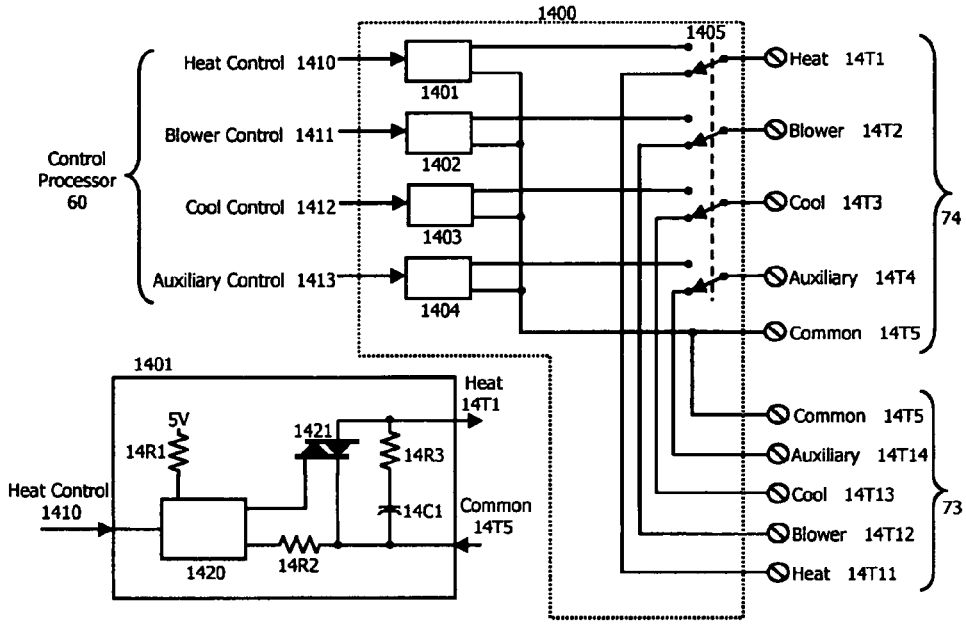
FIG. 14 is a schematic diagram of the control processor interface circuit to the existing HVAC equipment.

FIG. 14 is a diagram of the control processor 60 interface circuit 1400 to the existing HVAC controller 22 and existing thermostat 21. The interface circuit provides for four independent control signals called "Heat", "Blower", "Cool", and "Auxiliary". The present invention requires an HVAC system that has at least two controls: "Heat" and "Blower" or "Cool" and "Blower". Many residential HVAC systems have three controls: "Heat", "Blower", and "Cool". Some residential HVAC systems are more complex and use a fourth control. The present invention provides an "Auxiliary" control that may be used for different purposes. For example, "Auxiliary" can control the second speed of a two-speed blower, the second heating level of a two-level furnace, or the heating or cooling function of a heat pump used with a furnace. Standard residential HVAC controllers provide a common low voltage (36V) AC supply that turns on the HVAC equipment when a connection is made between the common supply and the corresponding HVAC control input. Connections can be made using dry contact switches or solid-state switches.

The present invention retains the existing thermostat for back up control. The multi-wire existing thermostat connection 73 is cut and both ends are spliced to wires that connect to the interface 1400. The corresponding existing HVAC controller wires are connected to terminals 14T1 for "Heat", 14T2 for "Blower", 14T3 for "Cool", 14T4 for "Auxiliary", and 14T5 for common AC supply from the HVAC controller. Likewise, the corresponding existing thermostat wires are connected to terminals 14T11 for "Heat", 14T12 for "Blower", 14T13 for "Cool", 14T14 for "Auxiliary", and 14T15 for common AC supply from the HVAC controller. Four output signals 1410, 1411, 1412, and 1413 from the control processor 60 connect through identical solid-state switches 1401, 1402, 1403, and 1404 and through switch 1405 to the corresponding terminals connected to the existing HVAC controller. Switch 1405 is a four-pole, double-throw slide switch shown in the position that connects the control processor to the existing HVAC controller. When switch 1405 is in the other position, the existing thermostat is connected to the existing HVAC controller.

Each solid-state switch 1401 through 1404 is comprised of an optoisolator triac driver 1420 connected to the control gate of triac 1421. One power terminal of the triac is connected to the common supply 14T5 from the existing HVAC controller. The other power terminal of the triac is connected to a control signal such as "Heat" 14T1 of the existing HVAC controller. The optoisolator is connected to the common supply by resistor 14R2 to provide the reference voltage for the triac gate signal. The triac is protected from high voltage spikes by the bypass path through resistor 14R3 and capacitor 14C1. The control signal 1410 from the control processor 60 connects to the input of optoisolator triac driver 1420. Resistor 14R1 limits the current used by the optoisolator when driving the triac. When the control signal is "1" (5V), no current flows through 14R1, the triac is off, and the HVAC equipment is off. When the control signal is "0" (0V), current flows through 14R1 and the optoisolator, the triac, and the HVAC equipment are on.

Figure 15:
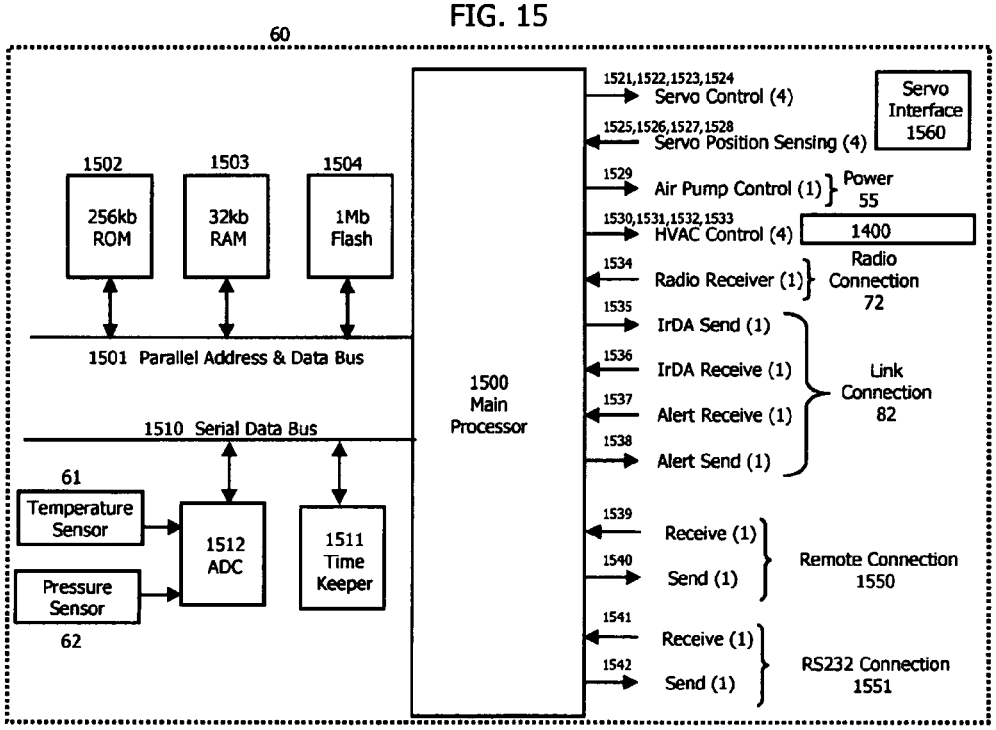
FIG. 15 is a block diagram of the control processor.

FIG. 15 is a block diagram of the control processor 60. The control processor uses standard components and standard design practices well known to those skilled in the art. In the preferred embodiment, the main processor 1500 is part number MC68332 manufactured by Motorola, Austin, Tex. The parallel address and data bus 1501 connects the processor to a 256 kb (kilobyte) ROM 1502 (read only memory) that contains the program, a 32 kb SRAM 1503 (static random access memory) used during execution, and a 1 Mb (megabyte) flash memory 1504 used to store house-specific data, temperature schedules, and records of the temperatures and HVAC activity.

The serial data bus 1510 connects to a timekeeper circuit 1511 comprised of an integrated circuit timekeeper, a 32 kHz crystal, and a watch battery. In the preferred embodiment, the integrated circuit is part number DS1302 manufactured by Dallas Semiconductor, Dallas, Tex. (now a wholly-owned subsidiary of Maxim Integrated Products, Inc., Sunnyvale, Calif.). The timekeeper circuit operates continuously, independent of the main processor, using a dedicated crystal and backup battery when the main processor is not powered. The timekeeper computes the current time of day with one-second resolution, the day of the week (1–7), the month (1–12), the day of the month (1–31), and the year (00–99), properly accounting for leap years. The main processor can set or read the time and date at any time using the serial data bus.

The serial data bus 1510 connects to a multi-channel 12-bit resolution ADC (analog-to-digital converter) 1512. The ADC encodes the analog signal from the plenum temperature sensor 61 and the analog signal from plenum pressure sensor 62. In the preferred embodiment, the ADC is an TSC2003 manufactured by Texas Instruments, the temperature sensor is an LM135 manufactured by STMicroelectronics, Carlton, Tex., and the pressure sensor is an MPXM2010 manufactured by Motorola, Austin, Tex. The pressure sensor output signal is amplified by a factor of 100 using a conventional op-amp circuit before conversion by the ACD. The main processor uses the serial bus to command the ADC to encode the pressure sensor or the temperature sensor. After a delay for the ADC to encode the signal, the main processor reads the encoded value using the serial bus.

The main processor has a plurality of programmable digital input and output signals used to control and monitor the components of the present invention. The valve motor 720 and position motor 910 are controlled by the four servo control signals 1521, 1522, 1523, and 1524. The photo-interrupters 741, 742, 930, and 931 are monitored by the servo position sensing signals 1525, 1526, 1527, and 1528. The servo interface 1560 has drivers for the valve and position motors and circuits to condition the signals from the photo-interrupters. The air pump 1020 is controlled by the air pump control signal 1529 and connected to the air pump by the power and control connection 55. The HVAC equipment "Heat" 1410, "Blower" 1411, "Cool"1412, and "Auxiliary"1413 are controlled by the HVAC control signals 1530, 1531, 1532, and 1533 that are connected to the HVAC interface circuit 1400. The radio receiver 71 is connected to the radio receiver signal 1534 by the radio connection 72. The IrDA send signal 1535 is connected to IrDA link 81 by link connection 82. The IrDA link 81 is connected by link connection 82 to the IrDA receive signal 1536. The alert receive signal 1537 and alert send signal 1538 are also connected to IrDA link 81 by link connection 82.

The preferred embodiment has provisions to control residential houses that have two or more independent HVAC systems. The remote receive signal 1539 and the remote send signal 1540 are connected by remote connection 1550 to a remote processor that controls the remote HVAC equipment, the servo controlled air valves, and measures the plenum temperature and pressure in the remote HVAC system. The remote system does not have a radio receiver 71 or an IrDA link 81.

During the installation process, the main processor communicates using the RS232 serial connection 1551 with a laptop computer used to configure and calibrate the system. The connection 1551 connects to the RS232 receive signal 1541 and the RS232 send signal 1542. The RS232 interface can also be used during operation to monitor system behavior or provide remote communications and control via a telephone modem or Internet connection.

Figure 16:
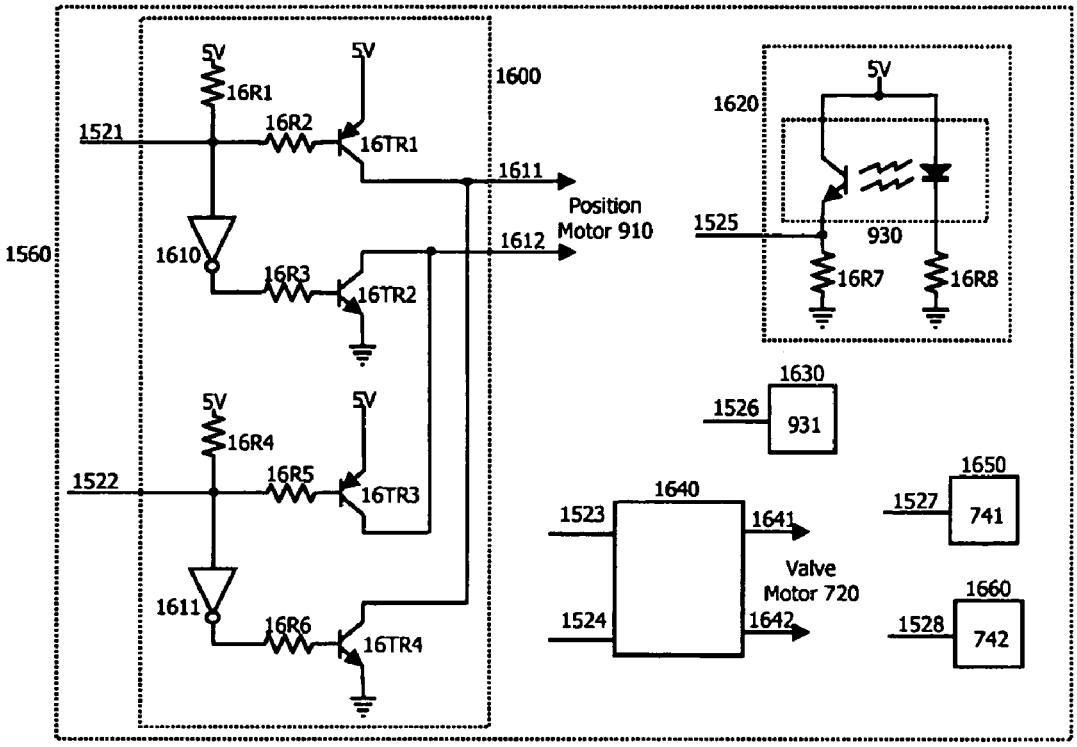
FIG. 16 is a schematic diagram of the servo interface circuit.

FIG. 16 is a schematic diagram of the servo interface 1560. The circuit 1600 is the driver interface for the position motor and identical circuit 1640 is the driver circuit for the valve motor. Signals 1521 and 1522 control the position motor 910 and signals 1523 and 1524 control the valve motor 720. These signals are in a high impendence state when the main processor 1500 is first started. When signal 1521 is "1" or in the high impedance state, resistor 16R1 connected to 5V through resistor 16R2 ensures that PNP transistor 16TR1 is not conducting and that the input to inverter 1610 is "1" so its output is "0", ensuring that NPN transistor 16TR2 is not conducting. Likewise, when signal 1522 is "1" or in the high impedance state, transistors 16TR3 and 16TR4 are not conducting. When signal 1521 is "0" and signal 1522 is "1", transistor 16TR1 is biased to conduct and the output of inverter 1610 becomes "1", causing transistor 16TR2 to conduct. Current flows from the 5V power supply through transistor 16TR1 to wire 1611 of the position motor, through the position motor, through wire 1612 and through transistor 16TR2 to supply ground, causing the position motor to turn CW. When signal 1521 is "1" and signal 1522 is "0", transistor 16TR3 is biased to conduct and the output of inverter 1611 is "1", so transistor 16TR4 is biased to conduct. Current flows from the power 5V supply through transistor 16TR3 to wire 1612 of the position motor, through the position motor, through wire 1611 and through transistor 16TR4 to ground, causing the position motor to turn CCW. Signals 1521 and 1522 are never both "0" at the same time. Signals 1523 and 1524 control the output signals 1641 and 1642 so that the valve motor 720 is driven CW when signal 1523 is "0" and is driven CCW when signal 1524 is "0".

Circuit 1620 includes the photo-interrupter 930 that is connected to the main processor signal 1525. Resistor 16R8 limits the current through the light emitting diode connected to 5V. Resistor 16R7 provides the load for the phototransistor so that when the light path is uninterrupted, the phototransistor conducts and the signal 1525 is "1". When the light path is interrupted, the phototransistor does not conduct, and signal 1525 is "0". The circuits 1630, 1650, and 1660 for photo-interrupters 931, 741, and 742 are identical to 1620 and function in the same way to produce signals 1526, 1527, and 1528.

System Installed on Plenum

Figure 17:
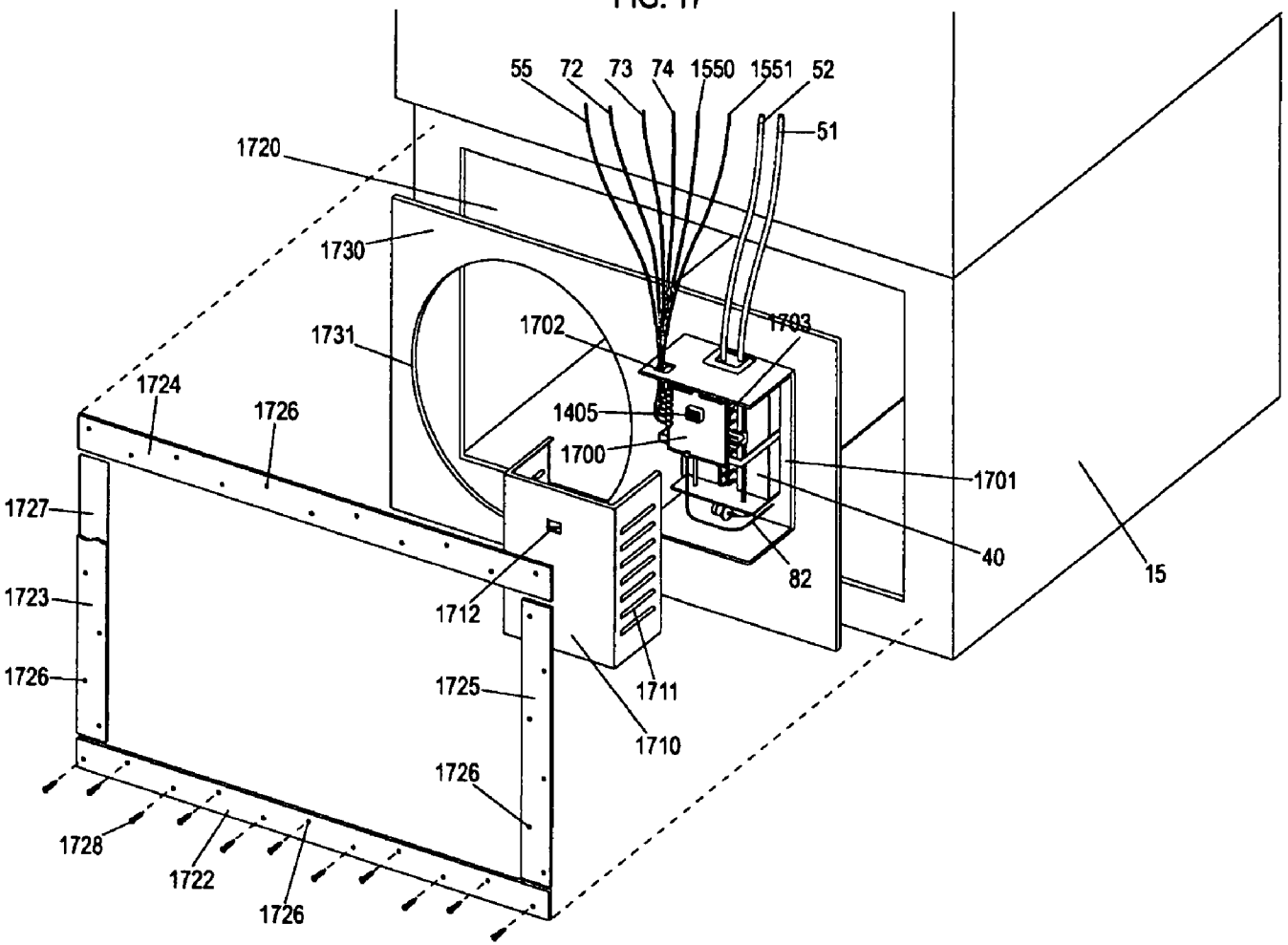
FIG. 17 is a perspective diagram of the control processor printed circuit board mounted in the main enclosure.

FIG. 17 is an exploded perspective view of the system components that are mounted on the conditioned air plenum 15. The control processor 60 and interface circuits are built on a PCB (printed circuit board) 1700 approximately 5"×5", which is mounted to the main enclosure base 1701. The PCB includes the terminals and sockets used to connect the control processor signals to the servo controlled air valves 40, the power and control connection 55, the temperature sensor 61, the pressure sensor 62, the radio receiver connection 72, the existing thermostat connection 73, the existing HVAC controller connection 74, the IrDA link connection 82, the RS232 connection 1551, and the remote connection 1550. Side 1703 of the main enclosure base 1701 has access cutouts and restraining cable clamps 1702 for the power and control connection 55, the radio connection 72, the existing thermostat connection 73, the existing HVAC controller connection 74, the RS232 connection 1551, and the remote connection 1550 (When used).

The main enclosure base 1701 has a cutout sized and positioned to provide clearance for the valve header 504 on the valve block 601 and valve block 602. The servo controlled air valve 40 as shown in FIG. 9 is mounted to the main enclosure base 1701. The main enclosure base also has cutouts for the pressure and temperature sensors to access the inside of the plenum and for the link connection 82 to pass from the plenum to its connector on the PCB 1700. The PCB is mounted above the air valve blocks. Side 1703 also has cutouts for the pressure air tube 51 and vacuum air tube 52 connected to the air-feed tee.

The main enclosure top 1710 fits to the base 1701 to form a complete enclosure. Vent slots 1711 in the main enclosure top provide ventilation. A cutout 1712 in the main enclosure top matches the location of switch 1405 on PCB 1700 so that when the main enclosure top is in position, the switch 1405 can be manually switched to either position.

To install the present invention, a hole 1720 approximately 16"×16" is cut in the side of the conditioned air plenum 15. The hole provides access for the process used to pull the air tubes 32 and to provide access when attaching the air tubes. The material removed to form the hole is made into a cover 1730 for the hole by attaching framing straps 1722, 1723, 1724, and 1725 to 1730. The framing straps are made from 20-gauge sheet metal approximately 2" wide. The mounting straps have mounting holes 1726 approximately every 4" and ¼" from each edge and have a thin layer of gasket material 1727 attached to one side. The straps are cut to length from a continuous roll, bent flat, and attached to the hole-material using sheet metal screws 1728 through the holes along the inside edge of the framing straps so that the framing straps extend approximately 1" beyond all edges of the hole-material. For clarity, only the screws used with framing strap 1722 are shown.

A rectangular hole is cut in the cover 1730 and is sized and positioned to match the cutouts in the bottom of the main enclosure base 1701 that provide clearance for the air valve headers and clearance for the pressure and temperature sensors and the link connection. The main enclosure base is fastened to the cover. After all connections from inside the plenum are made, the cover is attached to plenum using sheet metal screws through the holes along the outer edge of the framing straps. The gasket material on the mounting straps seals the mounting straps to the plenum and the cover 1730. When a bypass 90 is installed, it is often convenient to connect the bypass duct to the conditioned air plenum 15 through a hole 1731 in the cover 1730.

IrDA Link and Alert

Figure 18:
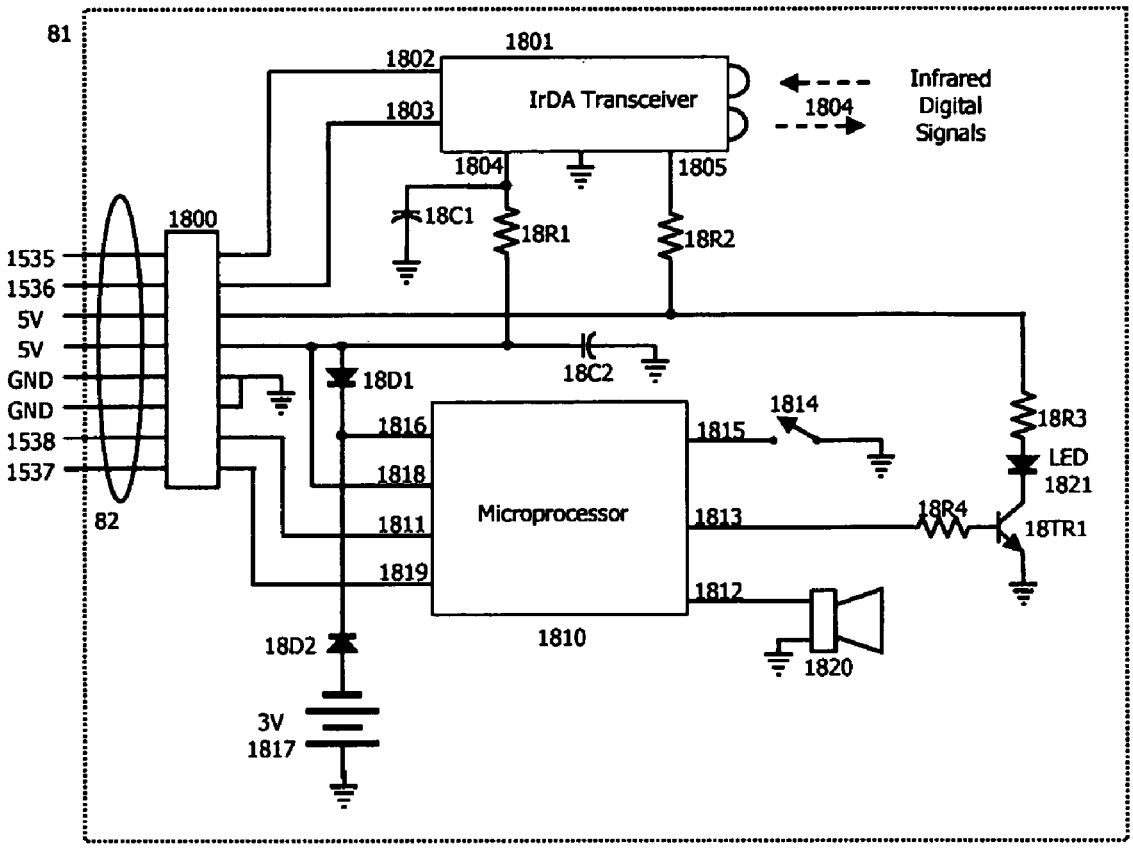
FIG. 18 is a schematic diagram of the IrDA link circuit.

FIG. 18 is a schematic diagram of the IrDA link 81 circuit. The link connection 82 is a plenum rated Category 5,8-conductor cable that connects to the IrDA link by a RJ-54 plug and socket combination 1800. Two conductors carry 5V power from the control processor to the IrDA link, two conductors are used to return power to ground, and four conductors are used for signals connected to the control processor. An integrated IrDA transceiver 1801 part number TFDU4100 manufactured by Vishay Telefunken, Heilbronn, Germany is used to generate and receive infrared digital signals 1804. Resistor 18R1 and capacitor 18C1 decouple the transceiver signal 1804 from power supply noise. The IrDA send signal 1535 is connected to the transceiver output 1802 by the IrDA connection 82. The current used by the infrared emitter is limited by resistor 18R2 connected to LED pin 1805. The received infrared light pulses are amplified to standard 5V logic "1" or "0" levels to generate the output signal 1803 connected to the IrDA receive signal 1536 by the IrDA connection 82.

The alert send 1538 signal is connected to input 1811 of the microprocessor 1810. In the preferred embodiment, the microprocessor is a PIC12C508 manufactured by Microchip Technology Inc., Chandler Ariz. The microprocessor output 1812 is connected to a piezo audio transducer 1820. Microprocessor output 1813 drives the base of transistor 18TR1 through resistor 18R4 so that the transistor conducts when output 1813 is "1", causing LED (light emitting diode) 1821 to emit light. Current flow through the LED and transistor 18TR1 is limited by resistor 18R3. When pushed, the reset push button switch 1814 connects "0" (ground) to microprocessor input 1815. The microprocessor output 1819 is connected to the alert receive signal 1537 by the IrDA link connection 82.

5V power from the control processor is decoupled by capacitor 18C2 and connected to the microprocessor power input 1816 through isolation diode 18D1. The 3V backup battery 1817 is connected to the microprocessor power input 1816 through isolation diode 18D2. Normally the microprocessor is powered by 5V from the control processor, and diode 18D2 isolates the power input 1816 from the battery. When power is not supplied by the control processor, the battery is isolated from the control processor power supply by diode 18D1 and the battery supplies power the to microprocessor. The microprocessor can operate using voltages between 2.5V and 5V. The 5V power from the control processor is connected to microprocessor input 1818 so the microprocessor can sense when the control processor is not supplying power.

The microprocessor is programmed to perform the alert functions specified by 8-bit commands from the control processor. The program can generate an audible tone of various frequencies by periodically inverting the logic level of output 1812 connected to the audio transducer 1820. Likewise, the LED can be flashed at various rates by periodically inverting the logic level of output 1813. Different combinations of tones and LED flashes are used to form different alerts. For example, a "Major Alert" is a continuously changing tone and a fast LED flashing, a "Minor Alert" is a single tone turned on and off for one second periods and a slow flashing LED, and a "Progress Alert" is a sequence of three tones and a single LED flash. An alert command from the control processor is sent as an 8-bit byte using a standard UART bit-serial protocol at 1200 bits per second. The microprocessor 1810 receives and decodes the command byte, and executes its program to generate the appropriate alert. A "Major Alert" is used to signal a major problem that needs immediate attention such as a non-functioning furnace. A "Minor Alert" is used to signal a minor problem such as a low battery indication from a thermometer. A "Progress Alert" is used to signal completion of a task such as establishing communications with the PDA 80.

The microprocessor is programmed to perform a "watch dog" function to ensure the control processor is functioning properly. One alert command is called the "I'mOK" command. The control processor must send this command to the microprocessor at least every minute. If the microprocessor does not regularly receive the "I'mOK" command, the microprocessor generates the "Major Alert". Likewise, if the control processor does not supply power, the microprocessor generates the "Major Alert". The occupant can turn off any alert by pushing the reset button 1814 connected to input 1815. The microprocessor sets the output signal 1819 to "1" when the reset button is pushed. This signals the control processor by signal 1537 that the occupant has acknowledged the alert. The control processor can send an alert command to reset the output 1819 to logic level "0".

Figures 19, 19A, 19B, 19C:
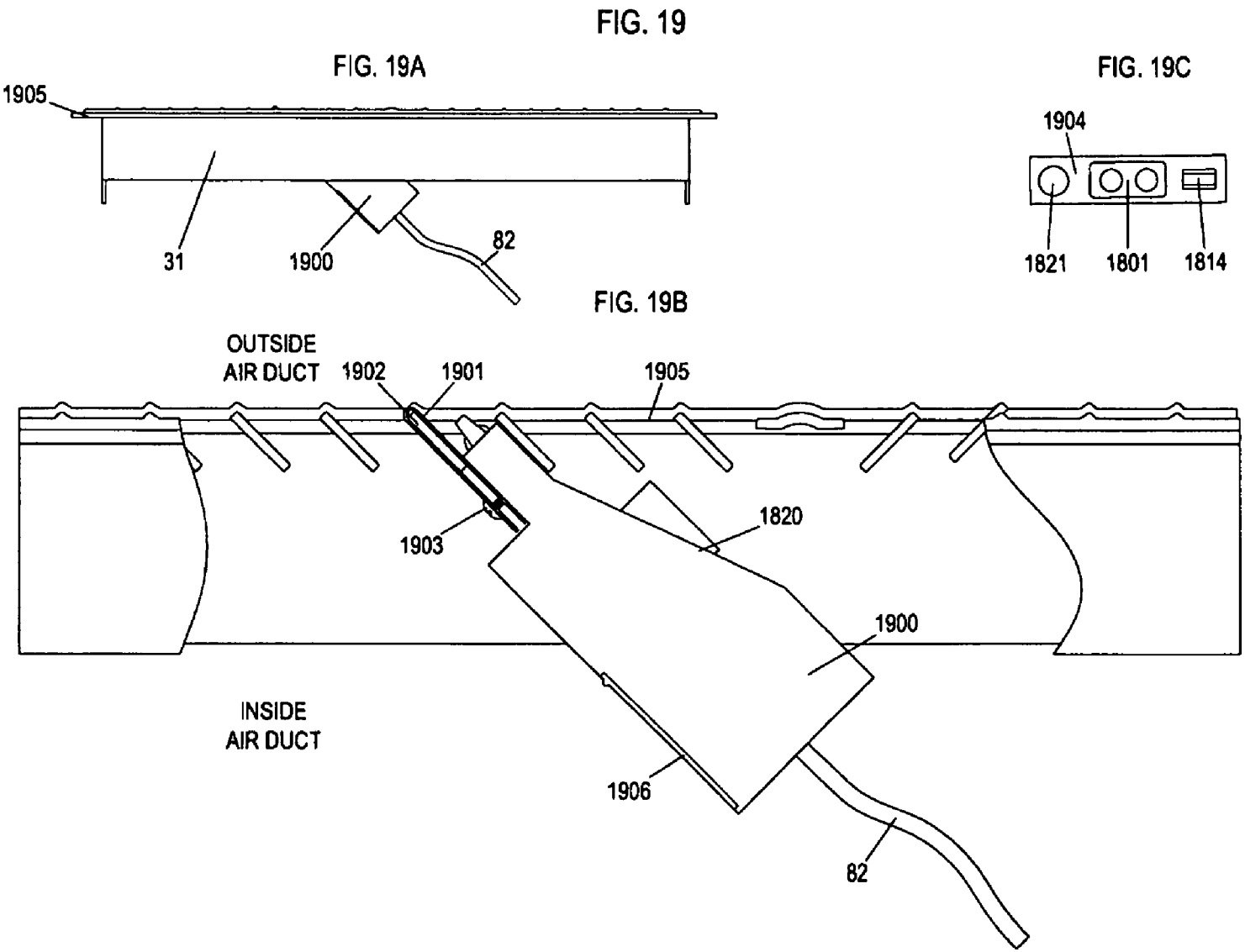
FIG. 19 is a drawing of the IrDA link enclosure installed in an air vent grill.

FIG. 19 shows three views of the IrDA link 81. FIG. 19A is a side view of the IrDA enclosure 1900 installed in an air vent grill 31. The outside surface 1905 of the air grill faces into the room and is typically flush with a floor, wall, or ceiling.

FIG. 19C is a view of the front 1904 of the IrDA link enclosure that secures and provides access to the LED 1821, the IrDA transceiver 1801, and the reset push button 1814.

FIG. 19B is an enlarged cut-away view of the IrDA link enclosure 1900 installed in the air vent. The enclosure is made of injection molded plastic. The IrDA link enclosure is attached to the grill by metal clip 1901 that is placed over a grill louver 1902 and secured by screw 1903. The IrDA enclosure is positioned so that the front 1904 including the LED, IrDA transceiver, and push button are placed facing towards the room slightly below the outside surface 1905 of the air grill. This position allows the IrDA to have line of sight to the PDA 80, the LED to be visible to the occupant, and the reset push button to be pushed by the occupant. The IrDA enclosure has a battery compartment 1906 that can be accessed without removing the enclosure from the grill. The link connection 82 connects to the IrDA enclosure using a RJ-45 plug and matching socket on the rear of the enclosure.

Interface Program to Specify Temperature Schedules and Programs

The present invention includes an interface program executed by the PDA 80 that is used to specify the temperature schedules applied to each room. The interface program can have many variations and operate on a variety of processors such as a standard PC or processor-display screen device designed specifically for the present invention. Likewise, the processor that executes the interface program can communicate with the control processor by a variety of wireless or wired methods. The described interface program is intended to be an example and not restrictive.

The interface program does not affect any other operation of the PDA, so the PDA can be used for other purposes. The PDA display screen is touch-sensitive and a stylus is tapped on the screen or moved on the screen to make selections and enter data. Selections are indicating by an inverted display that shows white areas as black and black areas as white. An object is selected when its display is inverted. The interface program follows the same protocols as other PDA programs so someone familiar with the PDA finds the interface program intuitive and easy to use. The standard PDA home menu is used to select the interface program.

Figure 20:
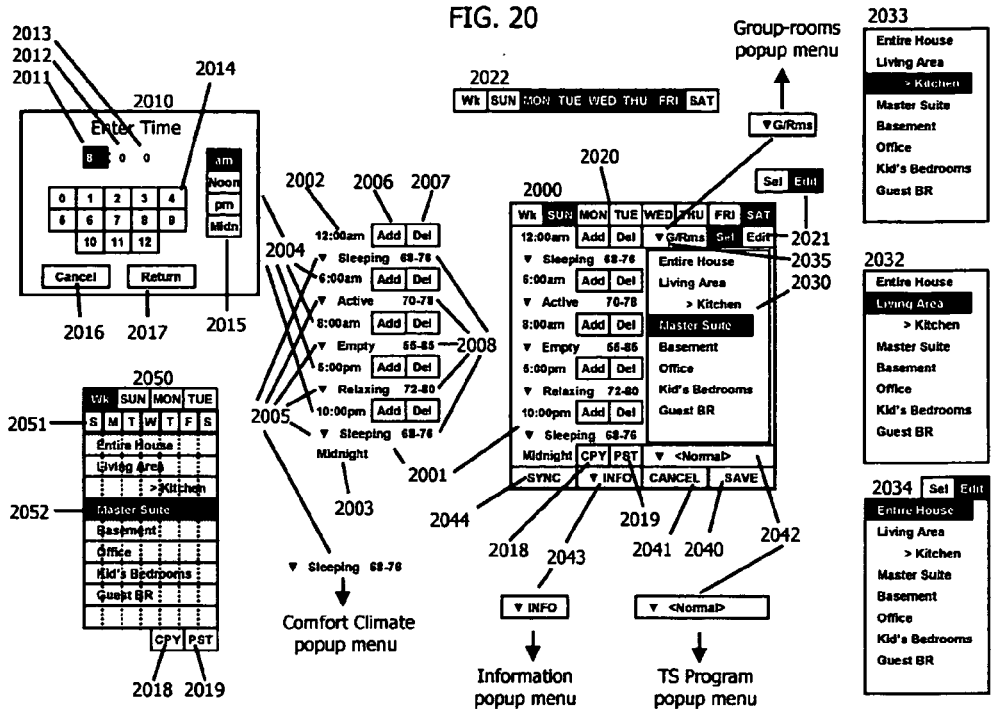
FIG. 20 illustrates the primary display screen of the PDA interface program.

FIG. 20 illustrates the primary display screen 2000 of the PDA interface program. The display screen is approximately 2"×2" with a resolution of 160 by 160 pixels. The temperature schedule 2001 displays a 24-hour day beginning at 12:00 am (ref. no. 2002) and ending at Midnight (ref. no. 2003). A number of specific times 2004 can be specified to divide the day into periods. Specific times are not required, so there may be only one period stretching from 12:00 am to Midnight. There can be as many as seven specific times 2004 so there can be as many as eight periods. A "comfort-climate" 2005 for each period is displayed on the line between the start time and the end time for that comfort-climate. The down pointing arrow indicates a popup menu is associated with each comfort-climate. Selecting any comfort-climate causes the "Comfort-Climate" popup menu 2100 to appear, shown in FIG. 21 and described in the following. Each comfort-climate display also displays a temperature range 2008. Selecting a temperature range causes the "Edit Comfort-Climate" popup menu 2110 to appear, shown in FIG. 21 and described in the following.

An "Add" selection 2006 and a "Del" selection 2007 is displayed on the same line and following "12:00 am" 2002, and on the same line and following each time 2004. Selecting "Add" causes all of the lines of the temperature display below the "Add" selection to be moved down by two lines. Then a new comfort-climate 2005 is added to first line below the "Add" selection, and a new time 2004 is added to the second line below the selected "Add" selection. This sequence of operations adds a complete new period to the 24-hour schedule. When the temperature schedule has more than five periods, the "Midnight" display 2003 is replaced with "More" and the first five periods are displayed. Selecting the "More" selection 2003 causes the last 5 periods to be displayed, the display 2003 to display "Midnight", and the display 2002 to display "More". Selecting the "More" selection 2002 causes the first 5 periods to be displayed. Selecting a "Del" selection 2007 deletes the period immediately below the selection, removing two lines from the temperature schedule display. The portions of the temperature schedule beginning three lines below the "Del" selection and ending with "Midnight" 2003 are moved up by two lines.

Selecting any of the times 2004 causes the "Enter Time" popup menu 2010 to appear. The numerical portions of the selected time 2004 are displayed by digits 2011, 2012, and 2013. Digit 2011 is displayed selected when the popup menu first appears. One and only one of these three digits can be selected at any time. Display 2014 has selections for digits "0", "1", . . . "12". Selecting one of these digits causes the selected digit 2011, 2012, or 2013 to be replaced by the digit selected in display 2014. When a digit 2011, 2012, or 2013 is replaced, the following digit 2012, 2013, or 2011 is automatically selected so that sequential selections in display 2014 sequentially enter the digits to specify the time. For digit 2011, the "0" selection cannot be made because it would specify an invalid time. For digit 2012, selections "6", "7", . . . "12" cannot be made. For digit 2013, selections "10", "11", and "12" cannot be made. Display 2015 has four selections "am", "Noon", "pm", and "Midn". One and only one of these can be selected at any time. The selections "am" and "pm" are combined with the numerical portion to complete the time selection. The "Noon" selection causes the time display 2004 to display "Noon" and the "Midn" selection causes the time display 2004 to display "Midnight". Selections on the "Enter Time" popup can be made in any order. Selecting "Return" 2017 causes the "Enter Time" popup to disappear and the newly selected time to be displayed in the selected time display 2004. Selecting "Cancel" 2016 causes the "Enter Time" popup to disappear and the selected time 2004 is unchanged.

Associated with the temperature schedule are a "CPY" selection 2018 and a "PST" selection 2019. Selecting "CPY" causes the displayed temperature schedule to be copied to memory for storage. Selecting "PST" causes the temperature schedule copied by the "CPY" selection to replace the currently displayed temperature schedule.

A "TS Program" is the set of temperature schedules by each room in the house on each day of the week. For example if a house has 15 rooms, then 7*15=105 temperature schedules comprise a full TS Program for that house. For most residential houses, the temperature schedule is the same for many rooms and many days of the week, so there are typically only a few different schedules. The extreme example is a single temperature schedule for all rooms and for all days. If the temperature schedule has a single 24-hour period, then the TS Program specifies that every room is conditioned to the same temperature all of the time. The 7-Day display 2020 and the Group-room display 2030 are used to display and to select the days and rooms that use the same temperature schedule.

The 7-Day display 2020 has selections "Wk", "SUN", "MON", . . . , "SAT" corresponding to the entire week ("Wk") and the days of the week Sunday, Monday, . . . , Saturday. The display has two modes: a "select-mode" and an "edit-mode". The "Sel Edit" selection 2021 displays the current mode so that "Sel Edit" indicates select-mode and "Sel Edit" indicates the edit-mode where a bold character corresponds to an inverted display. Selecting "Sel Edit" causes the mode to change to "Sel Edit" so that select-mode becomes edit-mode. Selecting "Sel Edit" causes the mode to change to "Sel Edit" so that edit-mode becomes select-mode. When the 7-Day display is in the select-mode, all days that use the displayed temperature schedule are displayed as selected. When any unselected day is selected, the temperature schedule for that day is displayed and all of the other days that use that same schedule are displayed as selected. For example, suppose the TS Program used one set of temperature schedules for weekdays and another set for weekend days. 7-Day display 2020 shows "SUN" and "SAT" selected, so the temperature schedule is used for weekend days. Selecting any of "MON" through "FRI" causes the display 2022 to display "MON" through "FRI" as selected and the weekend days as unselected. The weekday temperature schedule is displayed. When in the edit-mode, the 7-Day display is used to select the days that should use the displayed temperature schedule. Selecting a day changes the selection of that day. If the day is selected, it becomes unselected, if unselected it becomes selected. The temperature schedule does not change when day selections are made in the edit-mode.

The Group-room display 2030 selects groups and rooms. Its function is similar to the 7-Day display. The Group-room display has a "select-mode" and an "edit-mode" controlled by the "Sel Edit" selection 2021. The 7-Day display and Group-room display are either both in edit-mode or both in select-mode. The Group-room display 2030 displays all of the groups and rooms that use different temperature schedules. When in the select-mode, all of the groups and rooms that use the displayed temperature schedule are displayed as selected. Selecting any unselected group or room selects the temperature schedule used by that group or room and all of the groups and rooms that use that temperature schedule are displayed as selected. The displayed temperature schedule is uniquely identified by the 7-Day display 2020 day selections and the Group-room display 2030 group and room selections.

The PDA interface program automatically includes in the Group-room display 2030 all of the groups and rooms needed to represent the entire TS Program. If a room is part of a group and does not have a separate set of temperature schedules, then the room is not displayed. It is represented by its group. Typically, most of the rooms are grouped so a typical Group-room display has 3–5 groups and 2–5 rooms that use different temperature schedules.

When a room that belongs to a group uses different temperature schedules, it is displayed below its group, indented, and marked with a ">" symbol. Display 2032 displays the group "Living Area" with one of its member rooms "Kitchen". When "Living Area" is selected, the temperature schedule used by all of the rooms in the "Living Area" except "Kitchen" is displayed. When ">Kitchen" is selected as in display 2033, the temperature schedule used by "Kitchen" is displayed.

When in the edit-mode, the Group-room display is used to select the groups and rooms that should use the displayed temperature schedule. Selecting a group or room only changes the selection of that group or room. If it is selected, it becomes unselected, and if unselected it becomes selected. The temperature schedule does not change when a group or a room is selected or deselected when in edit-mode.

After editing a temperature schedule, selecting the "SAVE" selection 2040 saves the displayed temperature scheduled and assigns it to all of the selected groups and rooms in the Group-room display 2030 for all of the selected days in the 7-Day display 2020. The other temperature schedules and assignments in the TS Program are not affected. Selecting the "CANCEL" selection 2041 discards all of the changes made to the temperature schedule since the last "SAVE" or "CANCEL" selection. Changes made using any of popup menus are not affected. Any change made to the temperature schedule causes the 7-Day and Group-room displays to go to edit-mode. Selecting "SAVE" or "CANCEL" causes the 7-Day and Group-room displays to go to select-mode.

It is sometimes desirable to have all of the temperature schedules used by a group or room during the seven days of the week be assigned to other groups or rooms. When in the edit-mode, selecting the "Wk" selection in display 2020 causes all of the temperature schedules used by the selected group or room to be treated as a single 7-day temperature schedule. The temperature schedule display 2001 is replaced by display 2050. Each temperature schedule is represented by a rectangle outlined by a dotted line. Display 2051 represents each day of the week using the first letter of that day. The row of seven temperature schedules used by the selected group or room is displayed as selected. Display 2052 displays the 7-day temperature schedule used by the "Master Suite" as selected. The Group-room display 2030 displays as selected all of the groups and rooms that use that identical 7-day temperature schedule. Display 2050 displays as selected only the one group or room originally selected, while display 2030 displays as selected all groups and rooms that use that 7-day temperature schedule. Any group or room in the Group-room display 2030 can then be selected or deselected. The group or room that was originally selected to specify the 7-day temperature schedule can be deselected. Selecting the "Save" selection 2040 causes the 7-day temperature schedule to be assigned to the groups and rooms selected, causes the mode to become select-mode, and causes display 2050 to be replaced by the normal temperature schedule display 2001. The 7-Day display 2020 displays "Wk" as unselected and "SUN" as selected. Other days that use the displayed temperature schedule are displayed as selected. When in edit-mode, selecting the "CPY" selection 2018 causes the 7-day temperature schedule used by the selected group or room to be copied to memory. Selecting "CPY" does not change the edit-mode or any of the displays. When in edit-mode, selecting the "PST" selection 2019 causes the previously copied 7-day temperature schedule to be assigned to all of the groups and rooms selected in the Group-room display 2030. If a single temperature schedule was previously copied, then that temperature schedule is assigned to all days of the 7-day temperature schedule. When in edit-mode, selecting the "PST" selection 2019 causes the mode to become select-mode and causes display 2050 to be replaced by the normal temperature schedule display 2001. The 7-Day display 2020 displays "Wk" as unselected and "SUN" as selected. Other days that use the displayed temperature are displayed as selected. When in edit-mode, selecting the "CANCEL" selection 2041 discards all changes, causes the mode to become select-mode, and causes display 2050 to be replaced by the normal temperature schedule display 2001.

Likewise, it is sometimes desirable to have all of the temperature schedules used by all of the groups and rooms for one day of the week be assigned to other days of the week. When in the edit-mode, selecting the "Entire House"

selection in display 2030 causes all of the temperature schedules used during the selected day to be treated as a single entire-house temperature schedule. The temperature schedule display 2001 is replaced by display 2050. The column of temperature schedules associated with the selected day of the week is displayed as selected. The 7-Day display 2020 displays as selected all of the days that have an identical entire-house temperature schedule. Display 2050 displays as selected only the one day originally selected, while display 2020 displays as selected all days that use the same entire-house temperature schedule. Any day in the 7-Day display 2020 can then be selected or deselected. The day that was originally selected to specify the entire-house temperature schedule can be deselected. Selecting the "Save" selection 2040 causes the entire-house temperature schedule to be assigned to the days selected in the 7-Day display 2020, causes the mode to become select-mode, and causes display 2050 to be replaced by the normal temperature schedule display 2001. The Group-room display 2030 displays "Entire House" as unselected and the first group or room as selected. Other groups or rooms that use the displayed temperature schedule are displayed as selected. While in edit-mode, selecting the "CPY" selection 2018 causes the selected entire-house temperature schedule to be copied to memory. Selecting "CPY" does not change the edit-mode or any of the displays. While in edit-mode, selecting the "PST" selection 2019 causes the previously copied entire-house temperature schedule to be assigned to all of the days selected in the 7-Day display 2020. If a single temperature schedule was previously copied, then that temperature schedule is assigned to all temperature schedules in the entire-house temperature schedule. A copied 7-day temperature schedule cannot be assigned as an entire-house temperature schedule and a copied entire-house temperature schedule cannot be assigned as a 7-day temperature schedule. When in edit-mode, selecting the "PST" selection 2019 also causes the mode to become select-mode and causes display 2050 to be replaced by the normal temperature schedule display 2001. The Group-room display 2030 displays "Entire House" as unselected and the first group or room as selected. Other groups or rooms that use the displayed temperature schedule are displayed as selected. When in edit-mode, selecting the "CANCEL" selection 2041 discards all changes, causes the mode to become select-mode, and causes display 2050 to be replaced by the normal temperature schedule display 2001.

Selecting the "G/Rms" selection 2035 causes the "Edit Menu" popup menu 2200 to appear, shown in FIG. 22 and described in the following. This selection is used to add, edit, or delete the groups and rooms displayed in the Group-room display 2030.

Figure 22:
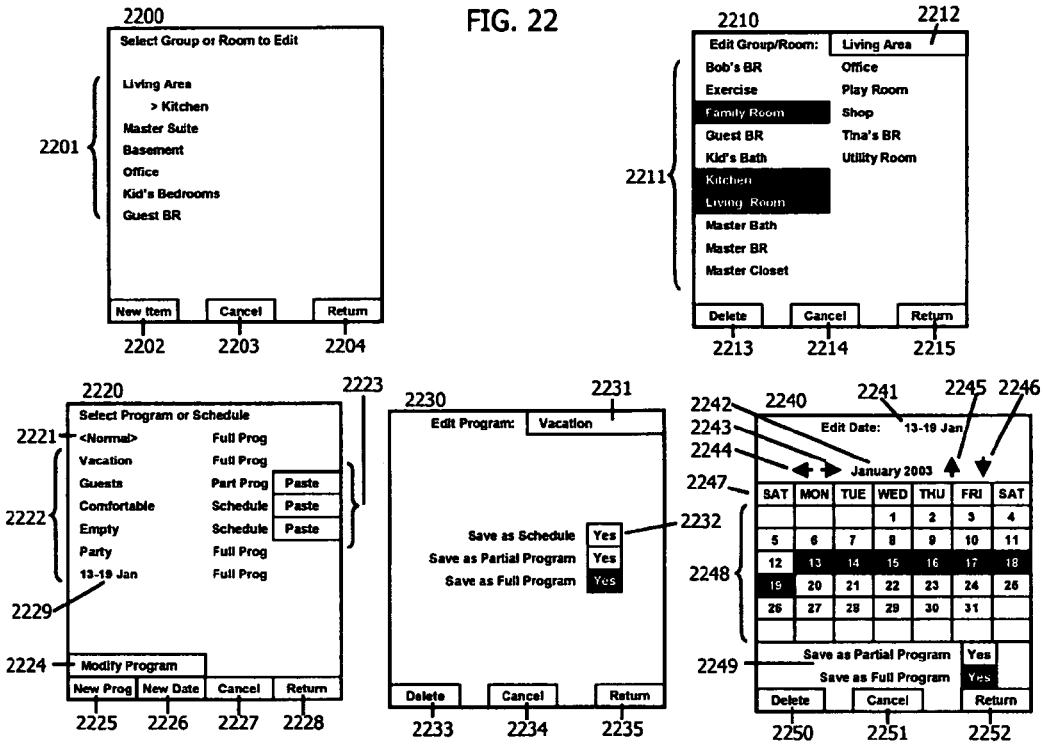
FIG. 22 illustrates the popup menus used to specify the Group-room menu and used to save and retrieve temperature schedule programs.

Selecting the "TS Program" selection 2042 causes the "TS Program" popup menu 2220 to appear as shown in FIG. 22 and described in the following. This selection is used to create, retrieve, save, or delete TS Programs or to specify a set of dates when a special TS Program is used.

Figure 23:
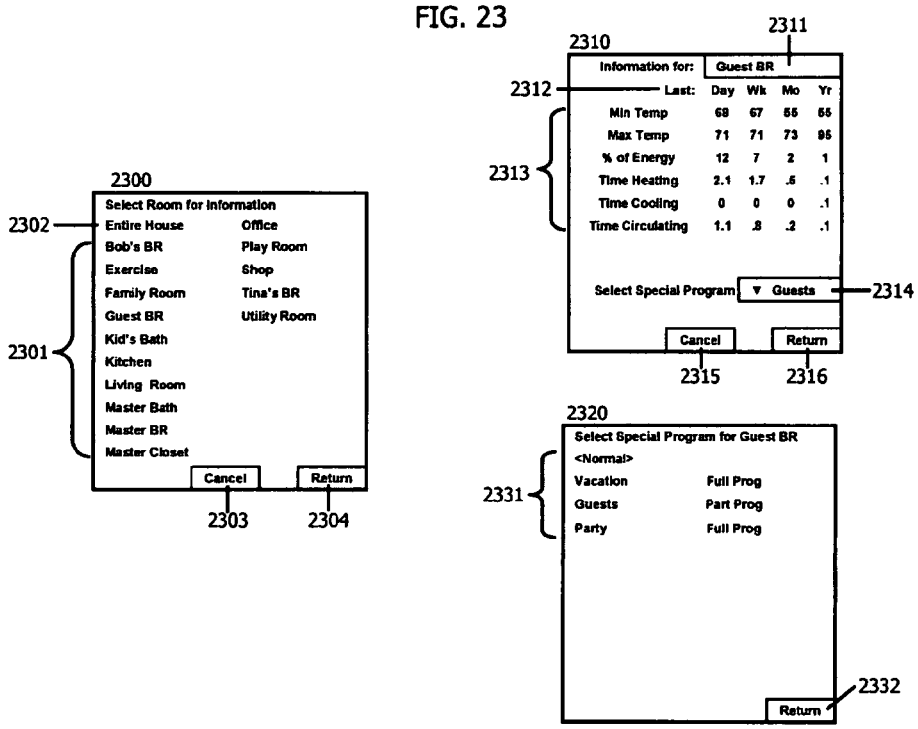
FIG. 23 illustrates the popup menus that display HVAC information for each room.

Selecting the "INFO" selection 2043 causes the "Information" popup menu 2300 to appear as shown in FIG. 23 and described below.

Selecting the "SYNC" selection 2044 causes the PDA 80 to attempt to establish an IrDA communications link with the control processor 60 and exchange information. The control processor sends data about HVAC configurations and activity, and maintenance needs to the PDA. The PDA sends all of the current TS Program information. The control processor maintains the master copy of the TS Programs and the information to initialize and adapt the PDA interface program to the house. Several different PDAs can be used in the same home, and the same PDA can be used in different houses, provided the proper password is used. The control processor generates a unique identification for each data exchange to manage merging changes from multiple PDAs using different versions of the data.

Figure 21:
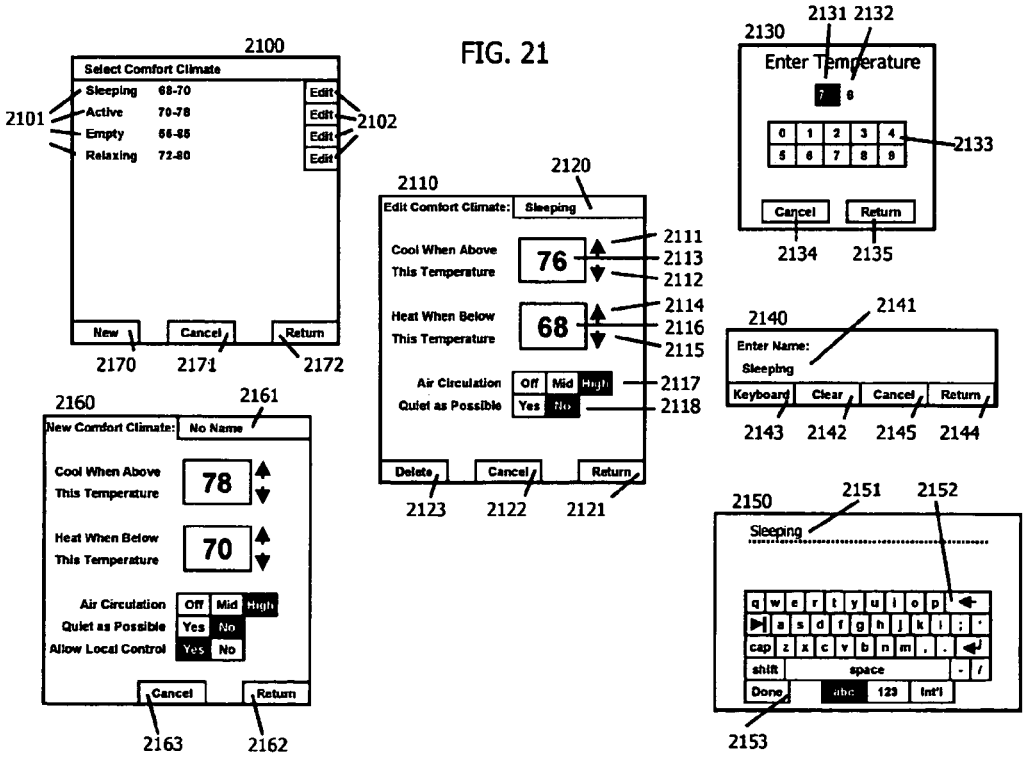
FIG. 21 illustrates the popup menus used to specify a Comfort-Climate.

FIG. 21 shows the "Comfort-Climate" popup menu 2100 that appears when a "Comfort-Climate" 2005 is selected. The popup menu 2100 displays the available "Comfort-Climates" selections 2101. Selecting a Comfort-Climate causes the popup to disappear and the selected Comfort-Climate to appear in the temperature schedule.

Each Comfort-Climate has an "Edit" selection 2102 that when selected, causes the "Edit Comfort-Climate" popup menu 2110 to appear. The "Cool When Above This Temperature" display 2113 displays the maximum temperature for the Comfort-Climate. Each selection of the up arrow 2111 causes the temperature display 2113 to increase by one. Each selection of the down arrow 2112 causes the temperature display to decrease by one. Selecting the temperature display 2113 causes the "Enter Temperature" popup menu 2130 to appear. The first digit of the temperature display 2131 is displayed as selected. The digit keyboard display 2133 has ten digit selections "0", "1", . . . "9". The digit 2131 is set by selecting a digit in display 2133. After the first digit is selected, the second digit display 2132 is selected. Digit 2132 is set by selecting a digit in display 2133. Selecting the "Return" button 2135 causes the popup menu 2130 to disappear and the entered temperature is displayed in display 2113. Selecting the "Cancel" button 2134 discards any changes and causes the popup menu 2130 to disappear.

The "Heat When Below This Temperature" display 2116 displays the minimum temperature for the Comfort-Climate. The temperature is set using the same process used to set the temperature display 2113. Selecting the up arrow 2114 increases the temperature, selecting down arrow 2115 to decreases the temperature, and selecting the temperature display 2116 causes the "Enter Temperature" popup menu 2130 to appear.

When not heating or cooling, the present invention can equalize temperatures by using the blower 12 to force unconditioned air to the warmer and cooler rooms. The temperatures are equalized as the return air mixes. The "Air Circulation" display 2117 provides three options to control circulation: "Off", "Mid", and "High". Circulation is turned off when "Off" is selected. The "Mid" selection turns on circulation when the temperature is more than four degrees above the heat-when-below-temperature or four degrees below the cool-when-above-temperature. The "High" selection turns on circulation when the temperature is more than two degrees above the heat-when-below-temperature or two degrees below the cool-when-above-temperature.

The present invention controls the noise produced by the HVAC blower by controlling the plenum pressure, and thus the air velocity through air vents and grills. The "Quiet as Possible" display 2118 has selections "Yes" and "No". When "Yes" is selected, the minimum plenum pressure is used when the comfort zone is in effect. For example, the Comfort-Climate used during sleep times in bedrooms may select "Yes" option. When "No" is selected, the maximum plenum pressure may be used.

The name display 2120 displays the name of the Comfort-Climate. When the name display 2120 is selected, the "Enter Name" popup menu 2140 appears with the name displayed in display 2141. The name can be edited of entered using the standard PDA "graffiti" strokes. Selecting the "Clear" selection 2142 clears the display 2141 so a new name can be entered. Selecting the "keyboard" selection 2143 causes the PDA keyboard popup menu 2150 to appear and the name (if any) from display 2141 to be displayed in display 2151. The name is edited or entered by selecting letters from the display area 2152. Selecting the "Done" selection 2153 causes the keyboard popup menu to disappear and the entered name to be displayed in the name display 2141. Selecting the "Cancel" selection 2145 cause any changes to be ignored, the "Enter Name" popup menu to disappear, and the name display 2120 is not clanged. When the name display 2141 displays the desired name, selecting the "Return" selection 2144 causes the name popup menu to disappear and the new name to be displayed in the name display 2120.

Selecting the "Cancel" selection 2122 causes any changes to be discarded and the "Edit Comfort-Climate" popup menu 2110 to disappear. Nothing in display 2100 is changed. Selecting the "Return" selection 2121 saves the changes and causes the popup menu 2110 to disappear. Selecting the "Delete" selection 2123 removes the Comfort-Climate from the display 2100 and the popup menu 2110 to disappear. A popup warning message appears if the deleted Comfort-Climate is used in any TS Program and a substitute Comfort-Climate must be selected before the delete is allowed.

Selecting the "New" selection 2170 in popup menu 2100 creates a new Comfort-Climate. The "New Comfort-Climate" popup menu 2160 appears with selections copied from the Comfort-Climate that was displayed when "New" was selected. The name display 2161 is initialized to "No Name". The popup menu 2160 is the same as 2110 except for the title and the initialization of the name display 2161. Selecting selection "Return" 2162 causes the popup menu 2160 to disappear and the new Comfort-Climate to be displayed in 2101. The heat-when-below-temperature and the cool-when-above-temperatures are displayed with the Comfort-Climate name. Selecting selection "Cancel" 2163 aborts the creation of the new Comfort Climate and causes the popup menu 2160 to disappear and no changes to be made to 2101.

Selecting the "Cancel" selection 2171 causes the popup menu 2100 to disappear and all changes to be discarded. This includes adding, editing, and deleting any of the Comfort-Climates. Selecting the "Return" selection 2172 causes the popup menu 2100 to disappear and all changes to be saved.

FIG. 22 shows the "Edit Menu" popup menu 2200 used to edit the Group-room display 2030. The groups and rooms displayed in the Group-room display are displayed in the 2201 display area. Selecting a group or room causes the "Edit Group/Room" popup menu 2210 to appear. The name of the selected group or the name of the selected room is displayed in the name display 2212. All of the rooms in the house are displayed in the display area 2211. If a group was selected, all of the rooms assigned to the group are displayed as selected. The rooms assigned to the group can be changed by selecting and deselecting rooms in the display 2211. Selecting the name display 2212 causes the "Enter Name" popup menu 2140 to appear and the group name can be edited. If a room was selected in display 2201, then that room is displayed as selected in display 2211, and one-and-only-one room may be selected. Selecting another room causes the name 2212 to display the name of the newly selected room and the previously selected room to be deselected. The room name cannot be edited using the popup menu 2210. Selecting the "Delete" selection 2213 causes the selected group or room to be removed from the display 2201 and the Group-room display 2030, and the "Edit Group/Room" popup menu to disappear. Selecting the "Cancel" selection 2214 discards any changes and causes the "Edit Group/Room" popup menu to disappear. Selecting the "Return" selection 2215 saves the changes and causes the "Edit Group/Room" popup menu to disappear.

Selecting the "New Item" selection 2202 causes the "Edit Group/Room" popup menu 2210 to appear with "No Name" displayed in the name display 2212. None of the rooms in the display 2211 is displayed as selected. Selecting a room causes its name to appear in the name display 2212. Selecting the "Return" selection 2215 causes the popup menu 2210 to disappear and the selected room to be added to the display 2201 and the Group-room display 2030. If two or more rooms are selected, a new group is created and given the default name "New Group" displayed in 2212. If the name "New Group" is already in use, a number is added to make the name unique: "New Group 2", . . . etc. Selecting the name display 2212 causes the "Enter Name" popup menu 2140 to appear and the group name can be edited.

Selecting the "Cancel" selection 2203 causes all of the changes to be discarded and the "Edit Menu" popup menu 2200 to disappear. The Group-room display 2030 is unchanged. Selecting the "Return" selection 2204 causes the display 2201 to be copied to the Group-room display and the "Edit Menu" popup to disappear.

FIG. 22 shows the "TS Program" popup menu 2220 that appears when the display 2042 is selected. Display 2221 is the default TS program "<Normal>" that cannot be renamed or deleted. Display 2222 displays all of the TS programs available for selection. There are three types of TS Programs: "Full Prog", "Part Program", and "Schedule". A "Full Prog" specifies the temperature schedule for all rooms for every day of the week. A "Part Prog" specifies the temperature schedules for some of the rooms and/or some of the days of the week. A "Schedule" is a single temperature schedule with no room or day specification. An existing TS Program is edited by selecting it in display 2222. This causes the popup menu 2220 to disappear and the selected TS Program name to be displayed in display 2042. The temperature display 2001 is replaced with display 2050. The rows and columns are displayed as selected to indicate the type of the selected TS Program. If the TS Program has type "Full Prog", then all 7-day temperature schedule rows and entire-house temperature schedule columns are displayed as selected. If the TS Program has type "Part Prog" then only the rows and columns stored in the program are displayed as selected. If the TS Program has type "Schedule", then none of the rows and columns are displayed as selected. Selecting any part of display 2000 causes display 2050 to be replaced by temperature schedule display 2001 and the 7-Day display and Group-room display to enter select-mode. The selected TS Program is viewed and edited as previously described. Selecting the "Save" selection 2040 saves all changes to the TS Program displayed in display 2042. If the TS Program has type "Part Prog" or "Schedule", selecting "Save" does not alter the days or rooms specified by the program.

TS Programs of type "Part Prog" and "Schedule" can overwrite portions of another TS Program. The "TS Program" popup menu 2220 displays a "Paste" selection 2223 for each TS Program of type "Part Prog" and "Schedule". Selecting a "Paste" selection 2223 causes the selected TS Program to overwrite portions of the TS Program being edited and causes the popup menu 2220 to disappear. For type "Part Prog" TS Programs, only the temperature schedules for the specified rooms and days associated with the "Part Prog" are overwritten. For type "Schedule" TS Programs, only the currently displayed temperature schedule is overwritten. Selecting "Paste" 2223 does not change the TS Program name displayed in TS Program display 2042.

Selecting the "New Prog" selection 2225 creates a new TS program. The "Edit Program" popup menu 2230 appears and the name display 2231 displays "New TS Program". Selecting the name display 2231 causes the "Enter Name" popup menu 2140 to appear and the default TS Program name can be edited. Display area 2232 has selections to specify the program type. One and only one of the three "Yes" selections can be made. Selecting the "Yes" selection associated with "Save as Schedule" sets the program type to "Schedule". Selecting the "Yes" selection associated with "Save as Full Program" sets the program type to "Full Prog". No information is needed from the 7-Day display or Group-room display. A type "Part Prog" TS Program has any combination of individual 7-day temperature schedules and/or entire-house temperature schedules. The current selections in the 7-Day display 2020 and the Group-room display 2030 specify the 7-day and entire-house temperature schedules to save. Each group or room selected in the Group-room display 2030 causes its 7-day temperature schedule to be saved in the TS Program. Each day selected in the 7-Day display causes its entire-house temperature schedule to be saved in the TS Program. If no day is selected in display 2020, the temperature schedule display 2001 is displayed as blank, and only 7-day temperature schedules are saved. If no groups or rooms are selected, the temperature schedule display 2001 is displayed as blank, and only entire-house temperature schedules are saved. Selecting the "Return" selection 2235 creates the TS Program as specified by the various selections and the popup menu 2230 disappears. The display 2222 displays the newly created TS Program. Selecting the "Cancel" selection 2234 discards any changes and the popup menu 2230 disappears. No changes are made to the display 2222.

"Modify Program" selection 2224 is used to modify existing TS Programs. The <Normal> TS Program cannot be modified. The TS Program displayed by display 2042 is modified by selecting the display 2042, which causes the "TS Program" popup menu 2220 to appear. Selecting the "Modify Program" selection 2224 causes the "Edit Program" popup menu 2230 to appear. Selecting the "Delete" selection 2233 deletes the TS Program from memory, removes the TS Program from the display 2222, sets display 2042 to "<Normal>", and causes the popup 2230 to disappear. The program type and the program name can be changed by making selections in the same way as described in the preceding for creating a new TS Program. Selecting the "Cancel" selection 2234 discards all changes and the popup menu 2230 disappears. Selecting the "Return" selection 2235 saves the changes and causes the popup 2230 to disappear.

A TS Program can be associated with a set of dates. The TS Program is only used for the specific dates associated with that TS program. Display 2229 shows a TS Program associated with the dates "13–19 Jan". The TS Program is known by the dates and has no other name. Selecting the "New Date" selection causes the "Edit Date" popup menu 2240 to appear. Selecting the "Modify Program" selection 2224 also causes the "Edit Date" popup menu 2240 to appear if the TS Program displayed in display 2042 is associated with a set of dates. The date display 2241 displays an alphanumeric abbreviation of the currently selected dates. The month-year display 2242 displays the selected month and year of the monthly calendar display 2248. Each selection of the right arrow 2243 causes the calendar to advance by one month. Each selection of the left arrow 2244 causes the calendar to go back one month. Each selection of the down arrow 2245 causes the calendar to advance by 7 days. The calendar then spans two months and the display 2248 displays the days of both months. Each selection of the up arrow 2246 causes the calendar to go back 7 days. Display 2247 displays the abbreviations for the days of the week. Any combination of dates can be selected in the monthly calendar display 2248. The stylus can be dragged across the calendar to select consecutive dates. The date display 2241 is changed as dates are selected and deselected. Display 2249 provides selections "Save as Partial Program" and "Save as Full Program" to select the TS Program type. (A "Schedule" type program cannot be associated with a date.) These TS Program type selections function as described in the proceeding for creating new TS Programs.

Selecting the "Delete" selection 2250 deletes the TS Program from memory, removes it from the display 2222, causes the display 2042 to display "<Normal">, and causes the popup 2240 to disappear. Selecting the "Cancel" selection 2251 discards all changes and the popup menu 2240 disappears. Selecting the "Return" selection 2252 saves the changes and causes the popup 2240 to disappear. The new or modified TS Program is displayed in display 2222.

FIG. 23 shows the "Information" popup menu 2300 that appears when the "INFO" selection 2043 is selected. The popup menu displays the "Entire House" selection 2302 and selections for each of the rooms 2301. Selecting a room or the Entire House causes the "Information" popup menu 2310 to appear. The display has an information display 2313 that displays the information provided by the control processor about the minimum and maximum temperatures, the average energy used, and the average number of hours spent each day heating, cooling, and circulating air for the selected room. Display 2312 labels the columns of data for the past day ("Day"), week ("Wk"), month ("Mo"), and year ("Yr"). Selecting the name display 2311 causes the "Enter Name" popup menu 2140 to appear and the room name can be edited. Selecting the "Select Special Program" selection 2314 causes the "Select Special Program" popup menu 2320 to appear. This menu contains all of the TS Programs that can be assigned to the "N/S" button 1207 on the thermometer assigned to the room. Selecting a TS program causes the popup menu to disappear and the TS program is displayed in the special schedule display 2314. This TS Program is used when "Special" is selected at the Thermometer. Selecting <Normal> as the Special Program disables the "N/S" button since <Normal> is assigned to both selections. Selecting the "Return" selection 2332 cause the popup menu 2320 to disappear and the display 2314 is not changed. Selecting the "Cancel" selection 2315 discards the selections and the popup menu 2310 disappears. Selecting the "Return" selection 2316 saves the selections and causes the popup 2310 to disappear. Selecting the "Cancel" selection 2303 discards all changes and causes the popup menu 2300 to disappear. Selecting the "Return" selection 2304 saves the selections and causes the popup 2300 to disappear.

Control Program

FIG. 24 is a high level flow diagram of the program executed by the control processor 60 to control the HVAC equipment and the temperatures in each room. At the start of the program, the initialization routine 2401 sets all variables and components to known initial conditions and four interrupt processes are initialized and enabled to interrupt. The timer interrupt 2405 uses the processor's internal timekeeper to provide programmable delays of less of a second used when controlling the valve motor and position motor. The thermometer interrupt 2402 is used to buffer the serial data from the radio receiver 71. The IrDA interrupt 2403 is used to communicate with the PDA 80. The remote interrupt 2404 is used to communicate with remote HVAC equipment or another computer during installation or when reporting information. Interrupts are disabled only while driving the position and valve motors and while servicing interrupts. Data collected while processing an interrupt is stored and a software flag is set. The interrupt flags are tested during common processing 2410, the data is processed, and the flags are cleared.

A data structure in common memory is associated with each thermometer. FIG. 25 is a listing of the definition of the data structure written in the C programming language. An array of structures named "zone" is declared so that each zone has a unique instance of the memory structure. All routines in the program can read and write any element in any structure using the name "zone[index].element". For example, zone[2].T[1] is used to read or write the number 1 element in the "T" array of integers in the number 2 instance of the zone data structure.

After initialization, the program executes an infinite loop with major branching controlled by state variable STATE that can have one of the following values: IDLE, HEAT, COOL, or CIRCULATE. The loop begins with common routines 2410 that are executed every pass through the loop. Examples of common routines are reading the timekeeper 1511, processing data from the thermometer radio receiver 71, processing the temperature schedules from the PDA 80 to set the heat when below temperatures (zone[i].HtoTemp) and cool when above temperatures (zone[i].CtoTemp) for all rooms, and recoding data for energy use analysis. After the common routines are executed, the state specific routines are executed.

When STATE=IDLE, all of the HVAC equipment 12, 13, and 14 is off and the air pump 50 is off. The temperatures are processed by 2411 to determine if heating, cooling, or circulation is needed. If not, STATE is unchanged and the loop is started again. If heating or cooling is needed, a thermal model is used to determine the optimal DURATION (in seconds) of the conditioning cycle. If circulation is needed, DURATION is set to 300 seconds, a reasonable time for most houses. The air valves are set so that the airflow goes only to the rooms needing conditioning or circulation. An airflow model is used to predict the plenum pressure with and without bypass 90 enabled. For some circumstances in some installations, it may be necessary to enable airflow to rooms that do not need conditioning so there is enough airflow to keep the plenum pressure below its maximum. STATE is set to HEAT, COOL, or CIRCULATE, and a secondary state variable STATE2 is set to zero.

The airflow model to predict plenum pressure that is used in the preferred embodiment is: plenum pressure=$k_0$/(sum(if on($k_i$))) where $k_0$ is a global scale factor an $k_i$ is a calibrated factor that represents the relative airflow capacity of the $i^{th}$ air vent. "if on($k_i$))" means that if the air vent is enable for airflow, the value is $k_i$, and if the airflow is disabled, the value is 0. If the system has an airflow bypass, the bypass is treated as though it was an air vent.

The values for k are calibrated during the installation process. The plenum pressure while blower 12 is running is measured for each of a number of different combinations of enabled air vents. If there are n k's to determine, about 4n different combinations are used, selected so that each air vent is enabled about the same name number of times over the 4n measurements. Then a standard iterative numerical process is used to find the set of values for the k's that produce plenum pressure predictions that best match the set of measured values. The value of $k_0$ is different when heating and cooling. This is calibrated by measuring the plenum pressure when heating and when cooling with a fixed set of air vents enabled, and then scaling the respective values of $k_0$ so the predicted plenum pressure matches the measured values. After calibration, the predicted plenum pressure is typically accurate within +/−5% of the measured plenum pressure.

The calibrated $k_i$'s are closely related to the airflow capacity of each air vent. Therefore, when any combination of air vents are enabled, the portion of the total airflow going through the $j^{th}$ air vent is $k_j$/(sum(if on($k_i$))). This is closely related to the portion of the energy used to condition the room associated with the $j^{th}$ air vent during a cycle of HVAC conditioning. Accumulating these portions for 24-hours for each air vent and for each HVAC cycle, and scaling by the total time of the HVAC cycles produces an accurate daily estimate of the percentage of energy used to condition each room.

The position motor and the valve motor are driven by routine 2412 to set all of the air valves to their proper pressure or vacuum position. This takes less than a minute. The common processing 2410 is not done while setting the air valves, but interrupts are enabled and processed between the times when the motors are driven. After the air valves are set, a control variable START_TIME is set to the current time read from the timekeeper 1511, the air pump 50 is turned on. STATE is tested by 2420, and if equal to HEAT, the heat routine 2413 is executed. STATE is tested by 2421, and if equal to COOL, the cool routine 2414 is executed. STATE is tested by 2422, and if equal to CIRCULATE, the circulate routine 2415 is executed. STATE is set to IDLE by routine 2416. This should never happen, but it ensures the loop continues if an error occurs.

Figure 26:
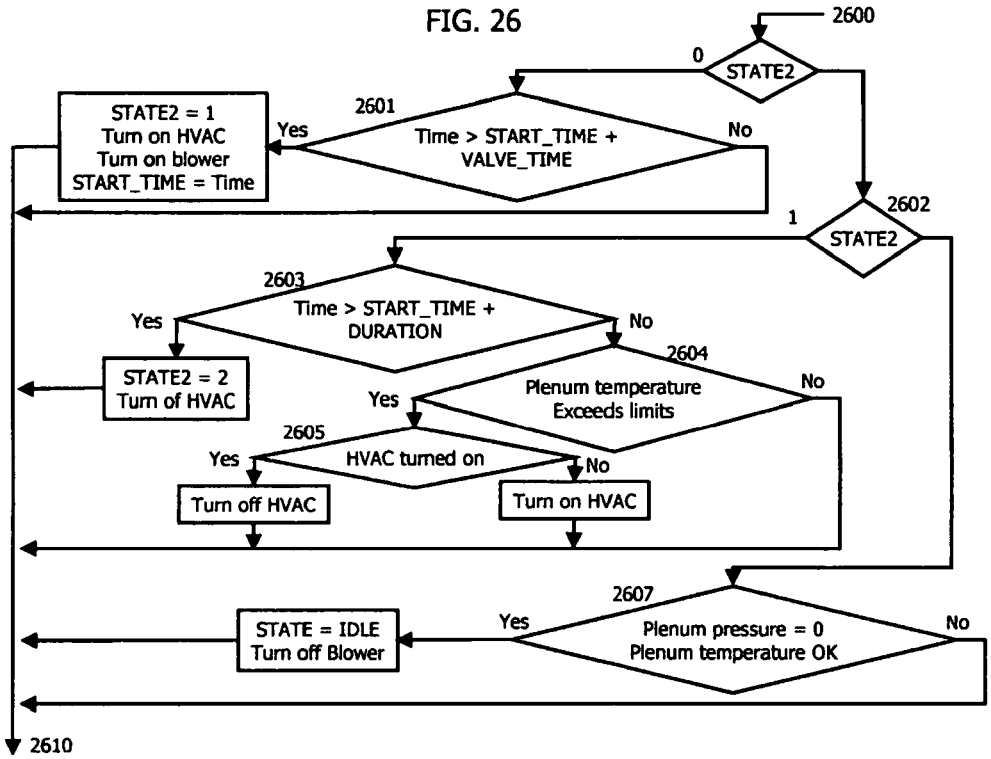
FIG. 26 is a flow diagram of the heat, cool, and circulate program routines.

FIG. 26 is a flow diagram of the heat, cool, and circulate routines. Each is adapted to control the appropriate HVAC equipment according to the needs of the equipment. When the routine is initially entered 2600, STATE2=0 and routine 2601 is executed. Routine 2601 causes a delay equal to VALVE_TIME (about 30 seconds) to allow the bladders to inflate before turning on the blower 12. "Time" represents the current time read from the timekeeper 1511. While the current time is less than START_TIME+VALVE_TIME, nothing is changed and the loop starting with common processing 2410 is repeated. After the delay, STATE2 is set to 1, the appropriate HVAC equipment and blower are turned on, START_TIME is set to the current time, and the loop is repeated. When STATE2=1, routine 2603 is executed. While the current time is less than START_TIME+DURATION, the HVAC equipment provides conditioning and routine 2604 is executed.

When bypass 90 is enabled, the plenum temperature many become too hot when heating or too cold when air conditioning. Routine 2604 uses the plenum temperature sensor 61 to measure the plenum temperature. In the heat routine 2413, when the plenum temperature exceeds the maximum, the furnace (or other heat source) 13 is turned off while blower 12 remains on. Circulation continues so that the plenum temperature decreases. After the plenum cools sufficiently, the heat is turned on. In the cool routine 2414, when the plenum temperature is less than the minimum, the air conditioner (or other cooling source) 14 is turned off while blower 12 remains on. Circulation continues so that the plenum temperature increases. After the plenum warms sufficiently, the cooling is turned on.

When the current time is more than START_TIME+DURATION, the HVAC equipment is turned off and STATE2 is set to 2. When STATE2=2, the routine 2607 is executed. For the circulate routine 2415, the plenum temperature and pressure checks are not used, so STATE is set to IDLE and the blower is turned off. For the heat routine 2413, circulation is continued until the plenum temperature is close to normal room temperature to ensure that most of the heat is transferred to the rooms. Then the blower is turned off and the plenum pressure monitored until it becomes zero. This ensures that the furnace controller is not continuing to run the blower. When the plenum pressure is zero, STATE is set to IDLE. For the cool routine 2414, circulation is continued until the plenum temperature is close to normal room temperature to ensure that most of the cooling is transferred to the rooms. Then the blower is turned off and the plenum pressure monitored until it becomes zero. This ensures that the cooling controller is not continuing to run the blower. When the plenum pressure is zero, STATE is set to IDLE.

Figure 27:
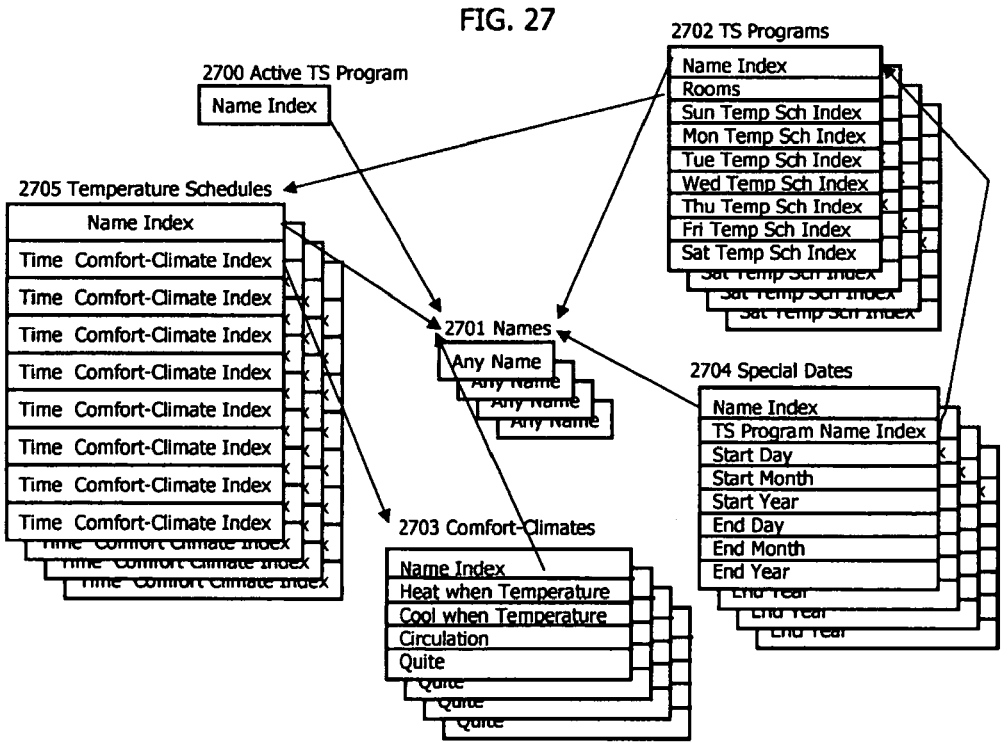
FIG. 27 illustrates the data structures used to store temperature schedule programs.

FIG. 27 is illustrates the data structures used to store the information specified in the PDA 80 using the interface program and transferred to the control processor 60. Information in these data structures are processed by the common processing 2410 to set the heat when below temperature and cool when above temperature for each room for each minute of each day. Each data structure has an 8-bit "Name Index" that corresponds to one of the names in the Names 2710 data structure. A name can be any combination of ASCII characters up to 20 characters long.

The Active TS Program 2700 "Name Index" specifies the currently active TS program.

The TS Programs 2702 data structure is identified by its "Name Index". Any number of TS Programs can have the same "Name Index". All TS Programs with their "Name Index" equal to the Active TS Program "Name Index" are processed. "Rooms" is a 32-bit binary number that specifies the rooms that use this TS Program. The first bit corresponds to the room assigned to the first instance of the zones data structure shown in FIG. 25. Each successive bit in "Rooms" corresponds to successive zone instances. The bit is set to "1" if the TS Program is used by its corresponding room. The PDA 80 interface program assures that one of the Active TS Programs is used by the entire house, so all of the bits in "Rooms" are set to "1". The Other Active TS Programs may have any number of "Rooms" bits set to "1".

The TS Program has a "Temperature Schedule Index" for each day of the 7-day cycle. The "Temperature Schedule Index" specifies an instance in the array of Temperatures Schedules 2705 data structures. Each Temperature Schedule has eight pairs of "Time" and "Comfort-Climate Index" values. The first pair specifies the Comfort-Climate in use from 12:00 am until the first "Time". The second pair specifies the comfort zone in use from the first "Time" until the second "Time" and so on.

The "Comfort-Climate Index" specifies an instance in the array of Comfort-Climate 2703 data structures. Each Comfort-Climate data structure has values corresponding to parameters that can be specified for the Comfort-Climates using the "Edit Comfort-Climate" popup menu 2110 shown in FIG. 21. "Heat When Below Temperature" and "Cool When Above Temperature" are used by routine 2411 to control the conditioning of each room.

The Special Dates 2704 data structure specifies a range of dates when the normal Active TS Program is replaced by a different TS Program. The "TS Program Name Index" identifies the TS Program for the special dates. The other six parameters specify the start date and the end date for the special TS Program as a day, month, and year. These correspond directly the dates read from the timekeeper 1511.

The data structures shown in FIG. 27 are processed by common processing routine 2410 to update the heat when temperature and cool when temperatures for each room. At the start of the processing, the Active TS Program "Name Index" is used to find all of the TS Programs that are active. The TS Program with the "Rooms"-bits all set to "1" is used first. The "Temp Sch Index" for the current day in the 7-day cycle is assigned to each room. Then, the TS Programs with two or more "Rooms"-bits set to "1" are processed. The "Temp Sch Index" from these programs is assigned to the rooms corresponding the to set "Rooms"-bits. Finally, the TS Programs with only one "Rooms"-bit set are processed and the "Temp Sch Index" from these programs is assigned to the rooms corresponding the to set "Rooms"-bits. Then all of the Special Dates 2704 data structures are processed to find any that apply to the current date. If any are found, the "TS Program Name Index" is used to find all of the additional TS programs that should also be used. If there is a "Rooms" with all bits set to "1", then the original Active TS Program is effectively replaced by the Special Dates TS Program. However, an entire house program is not required. The Special Dates TS Program can apply to a single room.

After the final "Temp Sch Index" is assigned for each room, the corresponding Temperature Schedules data structures 2705 are processed for each room to fine the "Comfort Zone Index" that is active for the present time. The corresponding "Comfort Zone" data structure 2703 for each room is used to set the heat to temperature, cool to temperature, and other parameters for the room.

Installing Air Tubes in Air Ducts

Figures 28, 28A, 28B, 28C, 28D, 28E, 28F, 28G, 28H:
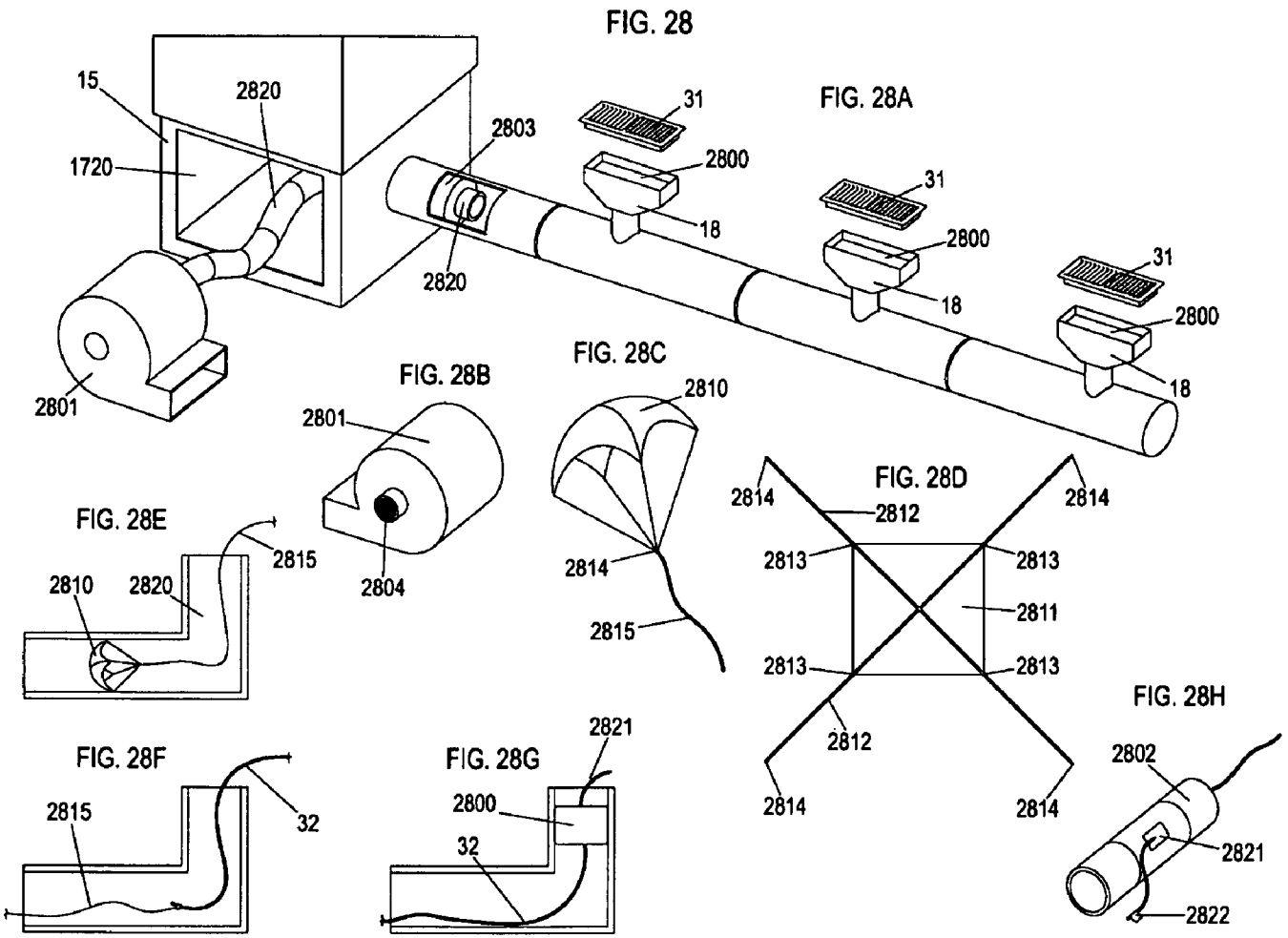
FIG. 28 illustrates the process used to install air tubes in air ducts.

The present invention is designed for easy installation in existing residential houses. Only access to the air vents and the central HVAC plenum 15 are required. All required installation processes are known to those skilled in the art of HVAC installation with the exception of pulling the air tubes 32 through the air ducts. The present invention includes a novel process for pulling the air tubes trough the air ducts. The description of the process refers to the views shown in FIG. 28. The method has the following steps:

1. Referring to FIG. 28A, all of the air grills 31 are removed and every air vent 18 connected by an air duct 16 to the plenum 15 is sealed using an oversized block of foam rubber 2800.

2. Referring to FIG. 28A, the access hole 1720 is cut in the air plenum 15.

3. Referring to FIG. 28A, a high-speed installation blower 2801 connected by flexible duct 2802 through hole 1720 and into the air duct 16. An airtight seal 2803 is formed at the end of the flexible duct between the outside of the flexible duct and the inside of the air duct 16. This seal can be made using foam rubber. The installation blower is connected so that the airflow is from the room air vents 18 towards the conditioned air plenum 15. FIG. 28B is a reverse view of the installation blower 2801 and its input 2804 that is connected to the flexible duct 2802.

4. A perspective view of an inflated parachute 2810 is shown in FIG. 28C. FIG. 28D illustrates the construction of the parachute. The parachute is made from a sheet of high strength plastic film 2811 about 0.002 inch thick and 16" by 16". Two strong strings 2812 approximately 6-feet long cross the plastic film and connect at the four corners 2813. Again referring to FIG 28C, the four ends 2814 are connected to a single long strong pull string 2815. Typically, a high quality 2001*b* test fishing line is used for pull string 2815.

5. Referring to FIG. 28D, the seal in the air vent 2820 furthest from the blower 2801 is removed, and the blower is turned on. This creates a large airflow from the one open vent, through the air duct, to the blower in the air plenum 15.

6. Referring to FIG. 28D, the parachute 2810 is introduced into the air vent while the pull string 2815 is held under tension. The airflow inflates the parachute sealing its edges to the inside of the air duct. This creates a strong pull on the parachute and in turn the pull string.

7. Referring to FIG. 28D, the parachute is pulled through the air duct toward the blower 2801 in the conditioned air plenum 15 as the string 2815 is let out.

8. If the parachute snags, it can be freed by pulling the string back and forth. This temporarily collapses the parachute so that turbulence in the airflow helps find another path for the parachute.

9. Referring to FIG. 28A, when the parachute reaches the blower, the blower is turned off, the flexible duct 2802 is removed from the blower, and the parachute is retrieved. A screen over the input 2804 (FIG. 28B) prevents the parachute from entering the blower.

10. Referring to FIG. 28F at the air vent, the air tube 32 is connected to the air vent end of pull string 2815.

11. Referring to FIG. 28A, the parachute end of pull string 2815 is used to pull the air tube through the air duct to the end of the disconnected flexible duct 2802.

12. Referring to FIG. 28H, which is a detailed view of the end of the flexible air duct 2802, the pull string 2815 is removed from the air tube. The air tube is labeled (ref. no. 2822) to associate it with the air vent 2820, passed through an air seal 2821 on the side of the flexible duct 2802, and the flexible duct is reattached to the installation blower 2801.

13. Referring to FIG. 28G at the air vent, the air tube is cut from the supply spool, secured inside the room 2821, and the air vent is resealed with the foam block 2800.

14. Process steps 5 through 13 are repeated for each of the remaining air vents, in order of furthest to nearest to the plenum 15.

15. After all of the air tubes are pulled, the flexible duct and seal are removed from the conditioned air plenum.

This process typically requires 5 to 15 minutes per air tube. If obstructions in an air duct block the parachute, then other conventional and more time consuming methods are used. After the air tubes are pulled, the installation can proceed using standard techniques.

From the forgoing description, it will be apparent that there has been provided an improved forced-air zone climate control system for existing residential houses. Variation and modification of the described system will undoubtedly suggest themselves to those skilled in the art. Accordingly, the forgoing description should be taken as illustrative and not in a limiting sense.

What is claimed is:

1. A zone climate control system for retrofitting to an existing forced-air system, the existing forced-air system including a blower, at least one of a heater and a cooler, a conditioned air plenum, and a plurality of air ducts, the zone climate control system comprising:

a plurality of inflatable bladders, each disposed within a respective one of the air ducts;

a plurality of air tubes, each coupled to a respective one of the bladders and extending through a respective one of the air ducts into the conditioned air plenum, wherein the plurality of air tubes extends outside the conditioned air plenum;

a plurality of valves each coupled to a respective one of the air tubes;

an air pump coupled to the plurality of valves to provide pressure and vacuum; and a computer-controlled valve actuator coupled to the plurality of valves for selectively coupling each air tube to a respective one of the pressure and the vacuum to accordingly inflate or deflate a respective one of the bladders and thereby block or pass air from the conditioned air plenum through the respective air duct.

2. The zone climate control system of claim 1 wherein:

the computer-controlled valve actuator is mounted to the outside of the conditioned air plenum.

3. A forced-air system comprising:

a blower;

at least one of a heater and a cooler coupled to the blower;

a conditioned air plenum coupled to the at least one of a heater and a cooler;

a plurality of air ducts coupled to the conditioned air plenum;

a plurality of air vents each coupled to a respective one of the air ducts;

a plurality of bladders, each disposed within a respective one of the air ducts;

a plurality of air tubes, each coupled to a respective bladder and extending from the respective bladder through the respective air duct into the conditioned air plenum;

a plurality of valves, each valve coupled between the air pump and a respective air tube;

a valve manifold coupled to the air pump and containing the plurality of valves;

an air pump coupled to the plurality of air tubes to inflate and deflate the bladders; and a mounting strap coupled to the bladder and to the respective air vent.

4. The forced-air system of claim 3 wherein the mounting strap includes:

an air tube clamp coupling the air tube to the mounting strap; and a mounting clamp coupling die bladder to the mounting strap.

* * * * *